US005168262A

United States Patent [19]

Okayama

[11] Patent Number: 5,168,262

[45] Date of Patent: Dec. 1, 1992

[54] FIRE ALARM SYSTEM

[75] Inventor: Yoshiaki Okayama, Tokyo, Japan

[73] Assignee: Nohmi Bosai Kabushiki Kaisha, Tokyo, Japan

[21] Appl. No.: 543,851

[22] PCT Filed: Dec. 1, 1989

[86] PCT No.: PCT/JP89/01210

§ 371 Date: Jul. 18, 1990

§ 102(e) Date: Jul. 18, 1990

[30] Foreign Application Priority Data

Dec. 2, 1988 [JP] Japan ..... 63-304177
Dec. 8, 1988 [JP] Japan ..... 63-308807

[51] Int. Cl.[5] ..... G08B 23/00

[52] U.S. Cl. ..... 340/523; 340/505; 340/510; 340/511; 340/514; 340/588

[58] Field of Search ..... 340/523, 506, 510, 511, 340/514, 870.16, 870.17, 870.09, 870.21, 505, 825.08, 588, 589

[56] References Cited

U.S. PATENT DOCUMENTS 4,556,873 12/1985 Yamada et al. ..... 340/511
4,668,939 5/1987 Kimura et al. ..... 340/511
4,727,359 2/1988 Yuchi et al. ..... 340/870.17
4,818,994 4/1989 Orth et al. ..... 340/870.21
4,881,060 11/1989 Keen et al. ..... 340/511

FOREIGN PATENT DOCUMENTS 59-157789 9/1984 Japan .
59-172093 9/1984 Japan .
61-98498 5/1986 Japan .

*Primary Examiner*—Donnie L. Crosland
*Attorney, Agent, or Firm*—Wenderoth, Lind & Ponack

[57] ABSTRACT

A fire alarm system employs a neural network for obtaining one or more types of fire related information values. A plurality of detection information values are time-serially collected from plural fire phenomenon detectors. The detection information values are signal processed such that a weighting coefficient is assigned thereto in accordance with a relative significance of the detection information value to the desired fire related information value. The various weighting coefficients are stored in advance in a memory. The weighting coefficients stored are established so that the fire related information value for a particular set of detection information values approximates a desired fire related information value.

11 Claims, 13 Drawing Sheets

FIG. 2

| PATTERN NUMBER | | SLV1 | SLV2 | SLV3 | SLV4 | SLV5 | SLV6 |
|---|---|---|---|---|---|---|---|
| 1 | INPUT | 0.070 | 0.070 | 0.070 | 0.070 | 0.070 | 0.070 |
| | OUTPUT (T) | 0.000 | | | | | |
| | OUTPUT (R) | 0.001 | | | | | |
| 2 | INPUT | 0.070 | 0.130 | 0.190 | 0.260 | 0.320 | 0.380 |
| | OUTPUT (T) | 0.200 | | | | | |
| | OUTPUT (R) | 0.156 | | | | | |
| 3 | INPUT | 0.070 | 0.190 | 0.320 | 0.450 | 0.580 | 0.630 |
| | OUTPUT (T) | 0.600 | | | | | |
| | OUTPUT (R) | 0.604 | | | | | |
| 4 | INPUT | 0.070 | 0.260 | 0.450 | 0.510 | 0.580 | 0.630 |
| | OUTPUT (T) | 0.600 | | | | | |
| | OUTPUT (R) | 0.598 | | | | | |
| 5 | INPUT | 0.260 | 0.320 | 0.380 | 0.450 | 0.380 | 0.580 |
| | OUTPUT (T) | 0.800 | | | | | |
| | OUTPUT (R) | 0.934 | | | | | |
| 6 | INPUT | 0.260 | 0.260 | 0.260 | 0.260 | 0.260 | 0.260 |
| | OUTPUT (T) | 0.000 | | | | | |
| | OUTPUT (R) | 0.200 | | | | | |
| 7 | INPUT | 0.260 | 0.190 | 0.130 | 0.130 | 0.070 | 0.070 |
| | OUTPUT (T) | 0.000 | | | | | |
| | OUTPUT (R) | 0.004 | | | | | |
| 8 | INPUT | 0.380 | 0.450 | 0.510 | 0.580 | 0.510 | 0.580 |
| | OUTPUT (T) | 1.000 | | | | | |
| | OUTPUT (R) | 0.984 | | | | | |
| 9 | INPUT | 0.380 | 0.380 | 0.380 | 0.380 | 0.380 | 0.380 |
| | OUTPUT (T) | 1.000 | | | | | |
| | OUTPUT (R) | 0.856 | | | | | |
| 10 | INPUT | 0.380 | 0.320 | 0.260 | 0.190 | 0.130 | 0.070 |
| | OUTPUT (T) | 0.100 | | | | | |
| | OUTPUT (R) | 0.008 | | | | | |
| 11 | INPUT | 0.380 | 0.260 | 0.130 | 0.070 | 0.130 | 0.070 |
| | OUTPUT (T) | 0.000 | | | | | |
| | OUTPUT (R) | 0.002 | | | | | |
| 12 | INPUT | 0.510 | 0.540 | 0.580 | 0.630 | 0.540 | 0.610 |
| | OUTPUT (T) | 1.000 | | | | | |
| | OUTPUT (R) | 0.997 | | | | | |
| 13 | INPUT | 0.510 | 0.510 | 0.510 | 0.510 | 0.510 | 0.510 |
| | OUTPUT (T) | 1.000 | | | | | |
| | OUTPUT (R) | 0.989 | | | | | |

FIG. 2'

| PATTERN NUMBER | | SLV1 | SLV2 | SLV3 | SLV4 | SLV5 | SLV6 |
|---|---|---|---|---|---|---|---|
| 14 | INPUT | 0.510 | 0.450 | 0.380 | 0.320 | 0.260 | 0.190 |
| | OUTPUT (T) | 0.300 | | | | | |
| | OUTPUT (R) | 0.238 | | | | | |
| 15 | INPUT | 0.510 | 0.380 | 0.260 | 0.130 | 0.260 | 0.190 |
| | OUTPUT (T) | 0.100 | | | | | |
| | OUTPUT (R) | 0.037 | | | | | |
| 16 | INPUT | 0.070 | 0.320 | 0.070 | 0.130 | 0.130 | 0.190 |
| | OUTPUT (T) | 0.000 | | | | | |
| | OUTPUT (R) | 0.006 | | | | | |
| 17 | INPUT | 0.070 | 0.190 | 0.510 | 0.450 | 0.380 | 0.380 |
| | OUTPUT (T) | 0.300 | | | | | |
| | OUTPUT (R) | 0.246 | | | | | |
| 18 | INPUT | 0.260 | 0.070 | 0.380 | 0.450 | 0.260 | 0.380 |
| | OUTPUT (T) | 0.600 | | | | | |
| | OUTPUT (R) | 0.609 | | | | | |
| 19 | INPUT | 0.260 | 0.510 | 0.260 | 0.260 | 0.320 | 0.260 |
| | OUTPUT (T) | 0.000 | | | | | |
| | OUTPUT (R) | 0.082 | | | | | |
| 20 | INPUT | 0.260 | 0.190 | 0.450 | 0.260 | 0.190 | 0.190 |
| | OUTPUT (T) | 0.000 | | | | | |
| | OUTPUT (R) | 0.085 | | | | | |
| 21 | INPUT | 0.380 | 0.450 | 0.130 | 0.580 | 0.380 | 0.510 |
| | OUTPUT (T) | 1.000 | | | | | |
| | OUTPUT (R) | 0.936 | | | | | |
| 22 | INPUT | 0.380 | 0.190 | 0.380 | 0.380 | 0.380 | 0.380 |
| | OUTPUT (T) | 1.000 | | | | | |
| | OUTPUT (R) | 0.833 | | | | | |
| 23 | INPUT | 0.380 | 0.070 | 0.260 | 0.190 | 0.260 | 0.190 |
| | OUTPUT (T) | 0.000 | | | | | |
| | OUTPUT (R) | 0.072 | | | | | |
| 24 | INPUT | 0.510 | 0.540 | 0.320 | 0.630 | 0.580 | 0.610 |
| | OUTPUT (T) | 1.000 | | | | | |
| | OUTPUT (R) | 0.986 | | | | | |
| 25 | INPUT | 0.510 | 0.190 | 0.380 | 0.320 | 0.380 | 0.260 |
| | OUTPUT (T) | 0.500 | | | | | |
| | OUTPUT (R) | 0.530 | | | | | |
| 26 | INPUT | 0.510 | 0.380 | 0.510 | 0.130 | 0.320 | 0.320 |
| | OUTPUT (T) | 0.500 | | | | | |
| | OUTPUT (R) | 0.477 | | | | | |

FIG. 2A

DEFINITION TABLE FOR BLOCK D (RAM 12)

| PATTERN NUMBER | SMOKE SENSOR NET OUTPUT OUTs | TEMP. SENSOR NET OUTPUT OUTt | GAS SENSOR NET OUTPUT OUTg | FIRE PROB T |
|---|---|---|---|---|
| 1 | 0.1 | 0.1 | 0.1 | 0.05 |
| 2 | 0.3 | 0.1 | 0.3 | 0.5 |
| 3 | 0.3 | 0.2 | 0.4 | 0.7 |
| 4 | 0.5 | 0.0 | 0.2 | 0.7 |
| 5 | 0.2 | 0.0 | 0.5 | 0.4 |
| 5 | 0.0 | 0.5 | 0.0 | 0.2 |
| 7 | 0.7 | 0.0 | 0.1 | 0.5 |
| 8 | 0.5 | 0.0 | 0.8 | 0.6 |
| 9 | 0.0 | 0.5 | 0.3 | 0.4 |

FIG. 8

WHEN $\sum_{m=1}^{26}(Em) = 0.07655$

INPUT STAGE - INTERMEDIATE STAGE

| | | | | | |
|---|---|---|---|---|---|
| $\omega 11$ -2.0853 | $\omega 21$ - .886901 | $\omega 31$ -3.8626 | $\omega 41$ .9975 | $\omega 51$ 2.6428 | $\omega 61$ 1.7948 |
| $\omega 12$ - .246001 | $\omega 22$ 3.3516 | $\omega 32$ - .9195 | $\omega 42$ -1.7186 | $\omega 52$ .977001 | $\omega 62$ -4.2909 |
| $\omega 13$ -1.8031 | $\omega 23$ 1.6126 | $\omega 33$ - .604001 | $\omega 43$ 2.5693 | $\omega 53$ -1.0438 | $\omega 63$ 3.4732 |
| $\omega 14$ -3.2664 | $\omega 24$ -1.8693 | $\omega 34$ 2.5785 | $\omega 44$ 1.2901 | $\omega 54$ -2.1903 | $\omega 64$ - .0357001 |

INTERMEDIATE STAGE - OUTPUT STAGE

| $V_{11}$ | $V_{21}$ | $V_{31}$ | $V_{41}$ |
|---|---|---|---|
| -6.0918 | -11.7389 | 10.3929 | -9.2186 |

FIRE ALARM SYSTEM

TECHNICAL FIELD

The present invention relates to a fire alarm system in which a plurality of physical quantities such as heat, smoke or gases attributable to a fire phenomenon are detected time-serially for thereby making a decision or judgement as to the occurrence of a fire on the basis of the plurality of time-serial physical quantities.

BACKGROUND TECHNOLOGY

In connection with a fire decision made on the basis of a plurality of sensor levels that vary with time and are detected time-serially as detection information representative of physical quantities involved in a fire phenomenon, there can be conceived a so-called discriminative pattern identification method according to which a table containing patterns based on a plurality of time-serial sensor levels together with fire information for each of the patterns is prepared and stored in a ROM or the like, wherein the pattern information in the table is compared with time-serial sensor levels actually detected, for thereby allowing the fire decision to be made.

Further, it is also conceivable to define a function having as variables the values of a plurality of time-serial sensor levels, wherein the fire decision is made on the basis of input/output relations with the aid of the function.

In any case, the decision as to whether or not a fire is occuring is based on the detected sensor levels. In this conjunction, it is extremely desirable if the fire monitoring operation can be effectuated with highly improved accuracy by virtue of the capability to finely and thoroughly monitor fire phenomena inclusive of smoldering fires and flaming fires while making available the information concerning the possibility of a fire, i.e. fire probability and the level of danger as well as the capability of eliminating the possibility of false alarm generation due to noise or other causes.

Accordingly, a first object of the present invention is to provide a fire alarm system for making a decision as to the occurrence of a fire on the basis of a plurality of sensor levels detected time-serially, a system which is not only capable of making a decision as to the occurrence of a fire but also capable of finely and thoroughly monitoring the fire probability and the level of danger as well as fire phenomena inclusive of smoldering fires and flaming fires with regard to such situations or states which may lead to a fire while eliminating the possibility of erroneous or false alarm generation from the influence of noise or the like.

In case fire information corresponding to a plurality of time-serial sensor levels should be defined in a table stored in a ROM or the like as described above in an effort to accomplish the above object, an increase in the number of input points or data would involve a more explosive increase in the number of combinations of such inputs, requiring prodigious labor and a large capacity ROM table for describing all the combinations, which would be practically impossible. Further, description of the input/output relations in terms of the functions as mentioned above is also practically impossible because of the limitation encountered in expressing such complex relations, not to say of the elimination of the possibility of erroneous or false alarm generation due to the influence of noise by the method relying on a table or function.

Accordingly, a second object of the present invention is to provide a fire alarm system having a signal processing structure suited for achieving the first object mentioned above.

DISCLOSURE OF THE INVENTION

In view of the above objects, there is provided according to a first mode of carrying out the present invention a fire alarm system in which detection information output from fire phenomenon detecting means is subjected to signal processing for obtaining a value for at least one type of fire information, the fire alarm system comprising:

detection information collecting means for collecting time-serially a plurality of detection information values from the fire phenomenon detecting means, and signal processing means for performing signal processing on the basis of the plurality of detection information values collected time-serially from said fire phenomenon detecting means by said detecting information collecting means by correspondingly imparting weights to each input time-serial detection information value, in accordance with degrees of contribution thereof to said fire information upon input of said time-serial detection information values, for thereby allowing the fire information value to be arithmetically determined on the basis of the weighted detection information values.

Further, according to a second mode for carrying out the present invention, there is provided a fire alarm system in which detection information output from a plurality of fire phenomenon detecting means is subjected to signal processing for obtaining a value for at least one type of fire information, the fire alarm system comprising:

detection information collecting means for collecting the detection information from each of the fire phenomenon detecting means while collecting a plurality of time-serial detection information values from at least one of said fire phenomenon detection means, and signal processing means for performing the signal processing on the basis of said plurality of detection information values collected from said plurality of fire phenomenon detecting means through said detection information collecting means by correspondingly imparting weights to each detection information value as input, in accordance with degrees of contribution thereof to said fire information upon inputting of said detection information values, for thereby allowing said fire information value to be arithmetically determined on the basis of the weighted detection information values.

In conjunction with a second mode for carrying out the invention, the signal processing means may be so implemented that the detection information values collected by the detection information collecting means can be input en bloc to the signal processing means whereon the latter correspondingly weights the input detection information values for arithmetically determining the fire information value, or the signal processing means may include first auxiliary processing means providing in correspondence with said at least one fire phenomenon detecting means by which said plural time-serial detection information values are collected, for performing an arithmetic operation to obtain individual fire information values, and second auxiliary processing means for processing the individual fire information values input from said first auxiliary processing means and detection information values input from the fire phenomenon detecting means which but collects, not time-serially a detection information value, to thereby derive the final fire information having highly enhanced reliability.

According to a third mode for carrying out the present invention, there is provided a fire alarm system for obtaining a value for at least one type of fire information by processing signals representative of detection information outputs from a plurality of fire phenomenon detecting means, which system comprises:

detection information collecting means for collecting time-serially a plurality of detection information values from each of said fire phenomenon detecting means; and signal processing means for performing signal processing on the basis of the detection information values collected by said detection information values collecting means from said plurality of fire phenomenon detecting means by imparting corresponding weights to each of said detection information values upon inputting thereof in accordance with an extent to which said each input detection information value contributes to said fire information and arithmetically determining said fire information value on the basis of the weighted detection information values.

In conjunction with a third mode for carrying out the invention, the signal processing means may be so implemented that the detection information values collected by the detection information collecting means can be input en bloc to the signal processing means, whereon the latter correspondingly weights the input detection information values for arithmetically determining the fire information value, or the signal processing means may include first auxiliary processing means provided in correspondence with said fire phenomenon detecting means by which said plural time-serial detection information values are collected, for performing arithmetic operation to obtain individual fire information values, and second auxiliary processing means for processing the individual fire information values input from said first auxiliary processing means to thereby derive final fire information having enhanced reliability.

In any one of the abovementioned modes for carrying out the invention, the signal processing means should preferably include storage means for previously storing weight values for correspondingly weighting the information values, respectively. The weight values stored in the storage means are so selected or established as to cause the fire information value arithemtically determined by said signal processing means in response to the input of a particular set of the information values to approximate desired fire information value which is to be derived from said particular set of the information values.

In conjunction with the preparation of the storage means, there may be provided a table for storing therein a particular set of information values together with at least one fire information value which is to be obtained when said particular set of information values is given and adjusting means for adjusting the weights so that said fire information value arithmetically determined by said signal processing means when said particular set of information values stored in said table is supplied can approximate said fire information value stored in said table, wherein said weight values stored in said storage area are adjusted by said adjusting means on the basis of the contents of said table.

Although this kind of storage means can be previously prepared at the manufacturing stage or at other appropriate times for subsequent use, it may initially be created internally of the fire alarm system upon initialization thereof. In case the storage means is created internally of the fire alarm system, the table and the adjusting means are also incorporated in the fire alarm system.

The adjusting means adjusts the weight values to be stored in the storage means such that the difference between a fire information value output from the signal processing net and the input/output value listed in the definition table is minimized. Once the storage means has been prepared in this manner, the signal processing means or the auxiliary signal processing means can perform an arithmetic operation by using the weight values stored in the storage means to thereby output the desired output values for all the input values. Thus, the signal processing means or the auxiliary signal processing means can cope with combinations of a plurality of time-serially detected information values which are not defined in the definition table, whereby the values representative of the desired fire information (fire probability, the level of danger, probability of the smoldering fire, etc.) can be indicated. In this manner, a finer fire decision can be made on the basis of the time-serially detected information values collected by the detected information collecting means.

As can be appreciated from the above, by using the storage area storing the weight values and the signal processing means (or auxiliary processing means), it is unnecessary to define all the pattern combinations but is sufficient to define the combinations only for the important points or locations when defining the input/output relations. Further, when the necessity arises for describing in detail among others those regions including a singular point or maximum or minimum point where the output values change remarkably even for a small deviation in the input value, then such regions and peripheries thereof may be defined finely with other regions being defined roughly.

When an input/output relation is to be changed, this can be achieved either by defining an output value for an input value differing from that defined previously or by creating a new definition for a region not yet defined. In this conjunction, it is noted that such alteration of the definition can be readily realized in the form of modification of the weight values by running the adjusting means (net structure generating program). In other words, by altering the definitions, it is possible to accurately realize a decision or judgement concerning a fire, danger, etc.

In any one of the modes for carrying out the invention, the practical embodiment of the signal processing means or auxiliary processing means should preferably be so implemented as to perform the arithmetical determination hierarchically, in which instead of straightforwardly calculating the fire information value from a plurality of detection information values collected by the detection information collecting means, interim or intermediate information values is once determined arithmetically from the information values as input, whereon the fire information value is arithmetically determined from the intermediate information values. Such hierarchical structure may be realized in stages comprising a plurality of intermediate layers, in each of which layers a desired number of intermediate information values to be arithmetically determined may be established. By way of example, in the case of a two-stage hierachical structure including an input-intermediate section and an intermediate-output section, the intermediate information values are once determined arithmetically from the input detection information values, whereon the fire information value to be output is determined arithmetically on the basis of the intermediate information values. In that case, initial weights are imparted separately for each of the input information values before deriving the intermediate information values, which is then followed by second weighting of the individual intermediate information values, respectively. In this manner, the fire information value can be determined as the output information. The values of the individual intermediate information plays no important role. The signal processing means may initially be adjusted upon initialization processing thereof or at any approate time point in a manufacturing process in respect to the first and second weight values by the aforementioned adjusting means.

When the fire alarm system comprises a receiving part such as a fire control panel and a plurality of fire detectors connected to the receiving part and each including at least one fire phenomenon detecting means for detecting a physical quantity attributable to the fire phenomenon, the abovementioned signal processing means may be incorporated either in the receiving part or in the fire detectors. When the signal processing means includes auxiliary processing means, a certain one or ones of the auxiliary processing means may be provided in the fire detectors while the remaining auxiliary processing means may be provided in the receiving part.

BRIEF DESCRIPTION OF THE DRAWINGS

FIGS. 2 and 2' and FIG. 2A are views showing definition tables employed in the first and second embodiments of the present invention, respectively, each containing defined inputs "INPUT" and defined outputs "OUTPUT(T)" together with actually measured fire information values "OUTPUT(R)" output from the net structure in response to a supply of the defined inputs "INPUT";

FIG. 8 is a view showing individual weight values used in obtaining the actually measured values of the fire information shown in FIG. 2.

BEST MODE FOR CARRYING OUT THE INVENTION

In the following, the present invention will be described in conjunction with exemplary embodiments thereof.

Figure 1:
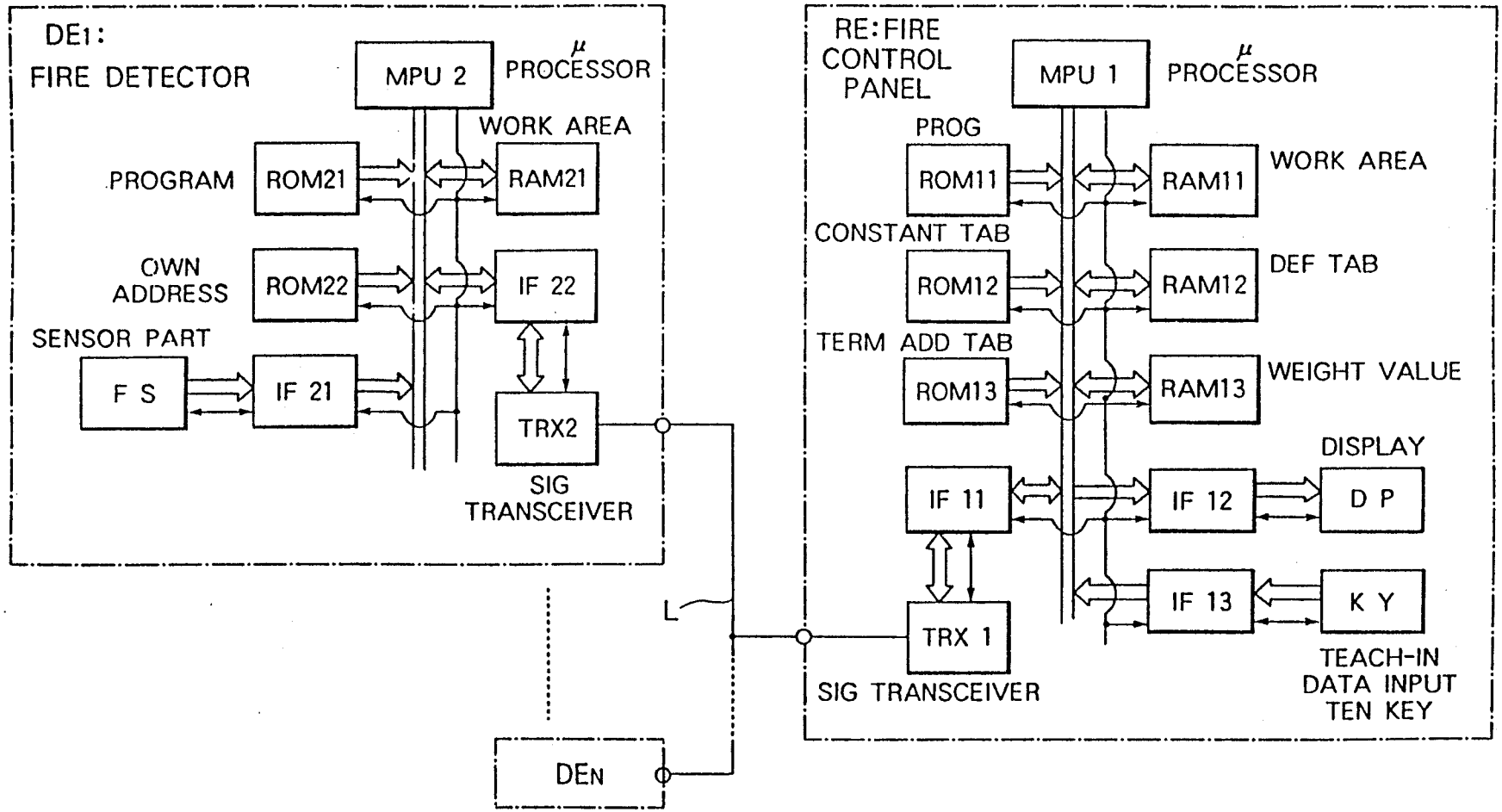
FIG. 1 and FIG. 1A are block circuit diagrams showing fire alarm systems according to first and second exemplary embodiments of the present invention, respectively.

FIG. 1 is a block circuit diagram showing a so-called analogue type fire alarm system to which an embodiment of the present invention is applied and in which sensor levels representative of analogue physical quantities inherent or attributable to the fire phenomena as detected by individual fire detectors are sent out to receiving means such as a receiver, repeater or the like, wherein the receiving means is adapted to make a decision as to the occurrence of a fire on the basis of the sensor levels as collected. However, it goes without saying that the present invention can equally be applied to an on/off type fire alarm system in which the decision as to the occurrence of the fire is made at the individual fire detectors, wherein only the results of the decision are sent to the receiving means.

In FIG. 1, reference character RE denotes a fire control panel, and $DE_1$ to $DE_N$ designate N analogue type fire detectors connected to the fire control panel RE by way of a transmission line L which may be constituted, for example, by a pair of conductors serving for both electric power supply and signal transmission, in which only one of the fire detectors is illustrated in detail with respect to the internal circuit configuration.

In the fire control panel RE:

MPU1 denotes a microprocessor:

ROM11 denotes a program storage area for storing programs relevant to the operation of the inventive system which will be described hereinafter;

ROM12 denotes a constant table storage area for storing various constant tables containing criteria and other information for discriminative identification of the fires for all of the fire detectors;

ROM13 denotes a terminal address table storage area for storing addresses of the individual fire detectors;

RAM11 denotes a work area;

RAM12 denotes a definition table storage area for storing definition tables for all of the fire detectors, as will be described hereinafter;

RAM13 denotes a weight value storage area for storing weight values of signal lines for all of the fire detectors, as will be described later;

TRX1 denotes a signal transmission/reception part which is constituted by a serial-to-parallel converter, a parallel-to-serial converter, etc.;

DP denotes a display such as a CRT or the like;

KY denotes a ten key for inputting data for teaching, as will be described hereinafter; and IF11, IF12 and IF13 denote interfaces, respectively.

Further, in connection with the fire detector $DE_1$:

MP2 denotes a microprocessor;

ROM21 denotes a program storage area;

ROM22 denotes an own address storage area;

RAM2 denotes a work area;

FS denotes a fire phemonenon detecting means for detecting physical quantities such as those of heat, smoke, gases or the like ascribable to a fire phenomena, which means is composed of a smoke sensor of the scattered light type in the case of the instant embodiment. The smoke sensor part FS includes a light emitting circuit, a light receiving circuit, a dark box of labyrinth structure, an amplifier, a sampling and hold circuit, an analogue-to-digital converter and others, although they are not shown;

TRX2 denotes a signal transmission/reception part similar to TRX1; and

IF21 and IF22 denote interfaces.

In precedence to the concrete description of the operation of the exemplary embodiment of the present invention which will be made later, a description will first be directed to the concept underlying the illustrated embodiments.

With the instant exemplary embodiment, it is contemplated to allow various fire decisions such as the probability of a fire and the degree or level of danger to be made rapidly and correctly on the basis of a plurality of sensor levels supplied time-serially from the sensor parts which detect the physical quantities of the fire phenomenon. To this end, the sensor levels from the sensor part sampled every fifth second are collected over a period of twenty-five seconds, wherein the six sensor levels in total are input to a net structure as a pattern to thereby allow the probability of a fire to be obtained as the output of the net structure, the operation of which will first be described by reference to FIGS. 2 and 3.

FIG. 2 shows a definition table which defines a true or highly accurate probability for 26 types of combinations or patterns of the six sensor levels, in which for each of the patterns numbered up to the 26-th pattern, six time-serial sensor levels are shown at the uppermost row labeled "INPUT". Of these six sensor levels, the leftmost one corresponds to the level sampled twenty-five seconds before, wherein the data subsequently sampled sequentially are shown serially in the direction from left to right as viewed in the figure. Accordingly, the rightmost data represents the sensor level sampled last. At the intermediate row labeled "OUTPUT(T)" for each of the patterns numbered, there are enumerated the probability of a fire in terms of numerical values in a range of "0" to "1" in association with the six sensor levels at the upper row, respectively. The sensor levels at the upper row are also given in terms of numerical values obtained through conversion or transformation processing. By way of example, the sensor levels of "0" to "1" correspond to the smoke concentrations in a range of 0 to 20%/m detected by a smoke sensor. At the lower row labeled "OUTPUT(R)", there are shown the values of the probability of the fire measured actually, as will be described later.

The probability "OUTPUT(T)" to be obtained when a single pattern of the six sensor levels shown in FIG. 2 is given can be derived generally on the basis of the concept which will be described below.

When the sensor level converted to a numerical value in the range of "0" to "1" exceeds "0.3" and when it is maintained constant or tends to increase, "0.2" is added to the value of the fire probability per interval. On the other hand, when the sensor level which exceeds "0.3" tends to decrease currently, "0.1" is added to the fire probability per interval. At all other intervals, "0" is added to the fire probability. The sum of these fire probabilities based on the six sensor levels and added together over all of the five intervals is utilized as the overall fire probability.

The above will be explained with the aid of expressions on the assumption that a certain sensor level is represented by $SLV_n$, the sensor level sampled five seconds later is represented by $SLV_{n+1}$, and that the fire probability ratio at each interval is represented by $S_m$ ($1 \leqq m \leqq 5$). The values of $S_m$ can be expressed in accordance with the values of $SLV_n$ and $SLV_{n+1}$, as follows:

When $SLV_n \geqq 0.3$ and when $SLV_n \leqq SLV_{n+1}$, $S_m = 0.2$.

When $SLV_n \geqq 0.3$ and when $SLV_{n-1} > SLV_n$, $S_m = 0.1$.

When $SLV_n < 0.3$ and when $SLV_n \leqq SLV_{n+1}$, $S_m = 0$.

When $SLV_n < 0.3$ and when $SLV_n > SLV_{n+1}$, $S_m = 0$.

Accordingly, the fire probability over all of the five intervals is given by $$S = \sum_{m=1}^{5} (S_m).$$

The overall fire probability S determined in the manner described above provided the base for deriving the values enumerated at the intermediate rows labeled "OUTPUT(T)" in the definition table shown in FIG. 2. However, all the values thus determined are not utilized intact as the values of "OUTPUT(T)", but instead the values most approximating the actual values are employed with the influence of noise, statistical data reliability and other factors in the environment where the sensors are installed taken into consideration. Further, for sensor levels not varying linearly, as can be seen in the patterns Nos. 20 to 26, similar definitions are adopted to ensure redundancy so as to sufficiently and elastically cope with the actual time-serial sensor level patterns. For example, in the case of the pattern No. 5, the output "OUTPUT(T)" assumes a value of "0.800" which should be "0.7" in accordance with the concept described above. This can be explained by the fact that the sensor level $SLV_5$="0.380" is ascribable to the influence of noise because only the sensor level $SLV_5$ falls extremely while the levels preceding and succeeding to the sensor level $SLV_5$ increases. Accordingly, in reality, the sensor level $SLV_5$ is considered to lie within a range of $SLV_4 < SLV_5 < SLV_6$. By taking this into account, "0.800" is placed at "OUTPUT(T)".

This kind of definition table can be prepared precisely on the basis of the concept described above and through experiments performed at places where the fire detectors are installed while taking into consideration the characteristics of the fire detectors and the statistical reliability of data. It is, however, practically impossible to prepare this sort of table for all the patterns let alone the twenty-six combinations of the six sensor levels. In contrast, according to the teachings of the present invention described subsequently, it is possible to determine accurately the fire probability for all the patterns on the basis of the six time-serial sensor levels with the filtering effect against noise, etc. being taking into account.

Figure 3:
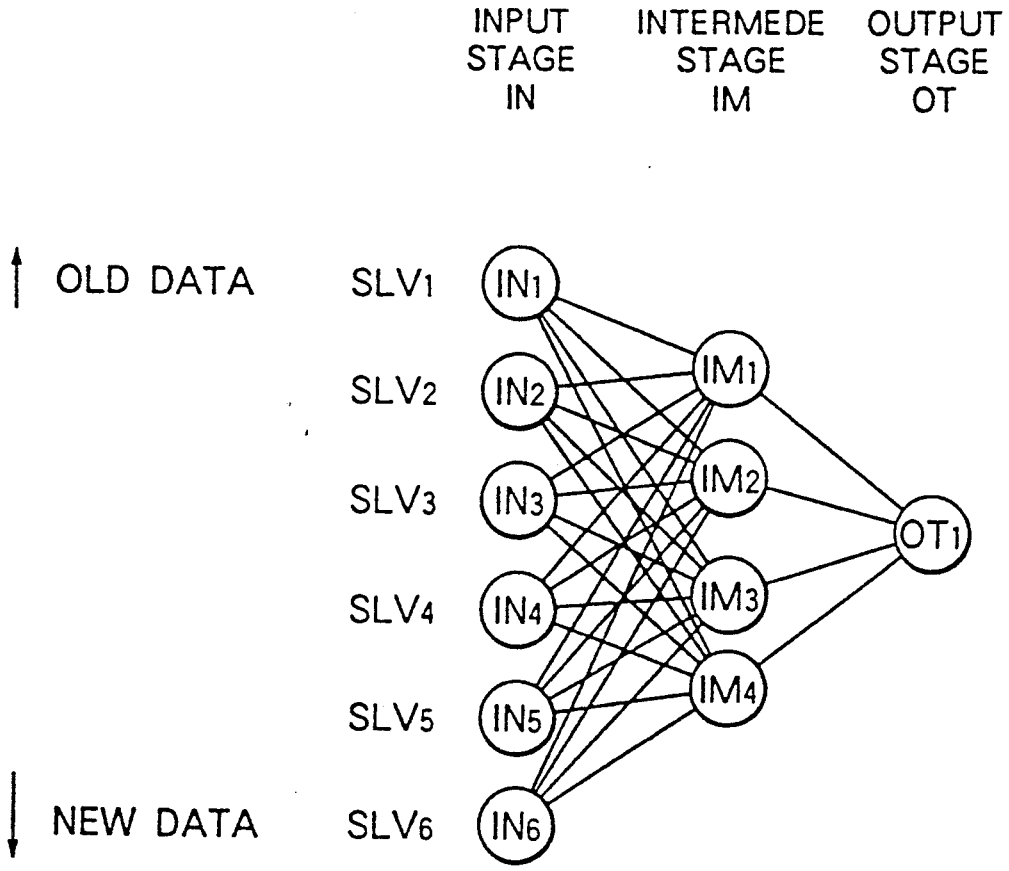
FIG. 3 and FIGS. 3A and 3B are views for conceptually illustrating signal processing nets employed in the first and second embodiments of the present invention, respectively.

Now, for convenience of elucidation of the teachings of the present invention, a net structure such as illustrated in FIG. 3 will be utilized. The object of this net structure, is to obtain the precise fire probability by supplying six sensor levels to the net structure on the assumption that such net structures are incorporated in the fire probability RE in correspondence with the individual fire detectors $DE_1$ to $DE_n$, respectively. In the net structure shown in FIG. 3, $IN_1$ to $IN_6$ indicated on the left-hand side will be referred to as the input stage layers, while $OT_1$ indicated on the right-hand side is referred to as the output layer or stage OT. There are input to the six input layers $IN_1$ to $IN_6$ the six sensor levels each converted to numerical values in the range of "0" to "1". On the other hand, there is output from the output layer $OT_1$ the fire probability represented by a numerical value from "0" to "1". Further, four layers $IM_1$–$IM_4$ shown, only by way of example, are referred to as intermediate stage layers, respectively. These intermediate stage layers $IM_1$–$IM_4$ receive the signals from the individual input stage layers $IN_1$–$IN_4$ and output the signals to the output stage $OT_1$. It is assumed that the signals travel from the input stage to the output stage without traveling in the opposite direction and without undergoing signal-coupling among the layers of the same stage. It is additionally assumed that no direct signal coupling is made from the input stage layers to the output stage. Accordingly, there exist twenty-four signal lines extending from the input stage to the intermediate stage. Similarly, four signal lines extend from the intermediate stage to the output stage.

The signal lines shown in FIG. 3 have respective weight values or coupling degrees which vary in dependence on the values to be output from the output stage in response to the signals input at the input stage, wherein signal transmission capability of the signal line is increased as the weight value thereof increases. The weight values of the twenty-four signal lines between the input stage and the intermediate stage, as well as the four signal lines between the intermediate stage and the output stage, and thus the weight values of twenty-eight signal lines in total, are stored in the weight value storage area RAM13 shown in FIG. 1 at the areas allocated to the individual fire detectors, respectively, after having been initially adjusted in accordance with the relations between the inputs and the outputs. The weight values thus stored are subsequently made use of in the fire monitoring operation.

In more concrete terms, the six values at the upper row "INPUT" for each of the pattern numbers (Nos.) in the definition table shown in FIG. 2 are supplied to the input stage layers $IN_1$ to $IN_6$, respectively, in accordance with a net structure generating program which will be described hereinafter, wherein the value output from the output layer $OT_1$ in response to the inputs mentioned above are compared with the fire probabilities $T_1$ listed at the intermediate row "OUTPUT(T)" in the table shown in FIG. 2 and serving as the teacher signals or the data for learning, and the weight values of the individual signal lines are altered so that the error or difference resulting from the comparison are reduced to a minimum. In this manner, data very closely approximating all of the functions shown in the definition table of FIG. 2 for only twenty-six combinations or patterns can be taught in the net structure shown in FIG. 3.

Now assuming that the weight value between the input stage layer INi and the intermediate stage layer IMj is represented by Wij with the weight value between the intermediate stage layer IMj and the output stage OTk being represented by Vjk (where $i=1\sim I$, $j=1\sim J$ and where $K=1$ with $I=6$, $J=4$ and $K=1$ in the case of the instant embodiment) and further assuming that each of the weight values Wij and Vjk can take positive, zero or negative values, the total sum $NET_1$ (j) of the inputs to the intermediate stage IMj is given by $$NET_1(j) = \sum_{i=1}^{I} (INi \cdot Wij) \quad \text{(Eq. 1)}$$

When the value $NET_1$ (j) is converted to a value in a range of "0" to "1" with the aid of the sigmoid function, for example, which is then represented by IMj, the following relation applies valid:

$$IMj = \frac{1}{1 + \mathrm{EXP}[-NET_1(j) \cdot \gamma_1]} \quad \text{(Eq. 2)}$$

Similarly, the total sum $NET_2$ (k) of the inputs to the output stage OTk can be expressed by:

$$NET_2(k) = \sum_{j=1}^{J} (IMj \cdot Vjk) \quad \text{(Eq. 3)}$$

When the value $NET_2$ (k) is converted to a value in the range of "0" to "1" by the sigmoid function, which is then represented by OTk, the following relation applies valid:

$$OTk = \frac{1}{1 + \mathrm{EXP}[-NET_2(k) \cdot \gamma_2]} \quad \text{(Eq. 4)}$$

In this manner, the relations between the input values $IN_1\sim IN_6$ and the output value $OT_1$ can be represented by the expressions Eq. 1 to Eq. 4 by using the weight values. In the above expressions, $\gamma_1$ and $\gamma_2$ represent adjustment coefficients of the sigmoid curve. In the case of the instant embodiment, they can be appropriately selected such that $\gamma_1=1.0$ and $\gamma=1.2$. By using these adjustment coefficients, it is possible to adjust the inclination of the sigmoid curve to thereby regulate the convergence rate for reducing errors.

In preparing the net structure generating program, one of the twenty-six patterns or combinations of the six sensor levels shown in the definition table stored in the storage area RAM12 is input to the input stage layers $IN_1\sim IN_6$, whereon the value of $OT_k$ (where $k=1$ in the case of the instant embodiment) output from the output stage as the result of the calculations according to the expressions Eq. 1 to Eq. 4 mentioned above is compared with the teacher signal outputs $T_1$ shown at the intermediate row in FIG. 2. At that time, any error Em which may occur at the output stage (where $m=1\sim M$ and $M=26$ in the case of the instant embodiment) is represented by the following expression:

$$Em = \sum_{k=1}^{K} \tfrac{1}{2}(OT_k - T_k)^2 \quad \text{(Eq. 5)}$$

where $OT_1$ represents the value determined in accordance with the expression Eq. 4 mentioned hereinbefore. The value E totaling the error Em for all the M patterns or combinations, i.e. the twenty-four combinations contained in the table of FIG. 2 is given by:

$$E = \sum_{m=1}^{M} (Em) \quad \text{(Eq. 6)}$$

Finally, an operation is performed for adjusting the weight values of the signal lines on a one-by-one basis so that the value E given by the expression Eq. 6 is minimized. The weight values stored in the fire detector area of the storage area RAM13 are updated with these new weight values to be utilized in the ordinary fire monitoring operation. The adjustment of the weight values for the signal lines as described above is performed for all the fire detectors included in the fire alarm system.

Upon completion of the teaching of the table contents shown in FIG. 2 for the net structure illustrated only conceptually in FIG. 3, i.e. upon completion of the adjustment of the weight values of the signal lines on a line-by-line basis, the actual fire monitoring operation is then performed by determining through calculation with the aid of a net structure calculation program (which will be described hereinafter) the value obtained from the output stage $OT_1$ in response to the input of the six sensor levels sampled time-serially over the period of twenty-five seconds to the input stage of the net structure in accordance with the expressions Eq. 1 to Eq. 4 mentioned above, wherein the fire decision is made by comparing the values resulting from the above calculation with the reference value of the fire probability.

In the foregoing description, it has been assumed that the number of information values input to the input stage layers is six with that of the information values output from the output stage being one. It goes, however, without saying that the number of input information values as well as of the output information values can be selected arbitrarily, as occasion requires. As the information values output from the output stage, there can be mentioned in addition to the fire probability other various information values such as the degree or level of danger, the concentration of smoke, seethrough or visible distance, etc.

Further, although it has also been assumed that there is one intermediate stage that includes four elements, the relation between the number of the elements included in one intermediate stage and those of the input information values and output information values is generally such that when the number of input information values is increased, the number of elements included in the intermediate stage should preferably be increased correspondingly in order to minimize error. Of course, by increasing the number of intermediate stages, the accuracy is further improved.

Further, it has been described that the total sum $NET_1$ (j) of the inputs to the individual elements at the intermediate stage as calculated in accordance with the expression (Eq. 1) is converted to a value in the range of "0" to "1" with the aid of the sigmoid function, wherein the value thus obtained is used in the expression (Eq. 3). It should, however, be mentioned that in place of the conversion of $NET_1$ (j) to a value of "0" to "1", $NET_1$ (j) can be directly used in the expression (Eq. 3) in place of $IM_j$. Even in that case, the final output information value is converted to a value in the range of "0" to "1" (Eq. 4) to be output from the output stage $OT_1$.

In the illustrated embodiment, neither the elements or layers at the intermediate layer stage are mutually coupled, or are the elements of the input and output stages mutually coupled. Nevertheless, the object of the present application can be accomplished by altering the weight values in such a sense that error is reduced.

FIG. 4 to FIG. 7 are flow charts for illustrating operations of the inventive system executed in accordance with programs stored in the storage area ROM1 shown in FIG. 1.

Figure 4:
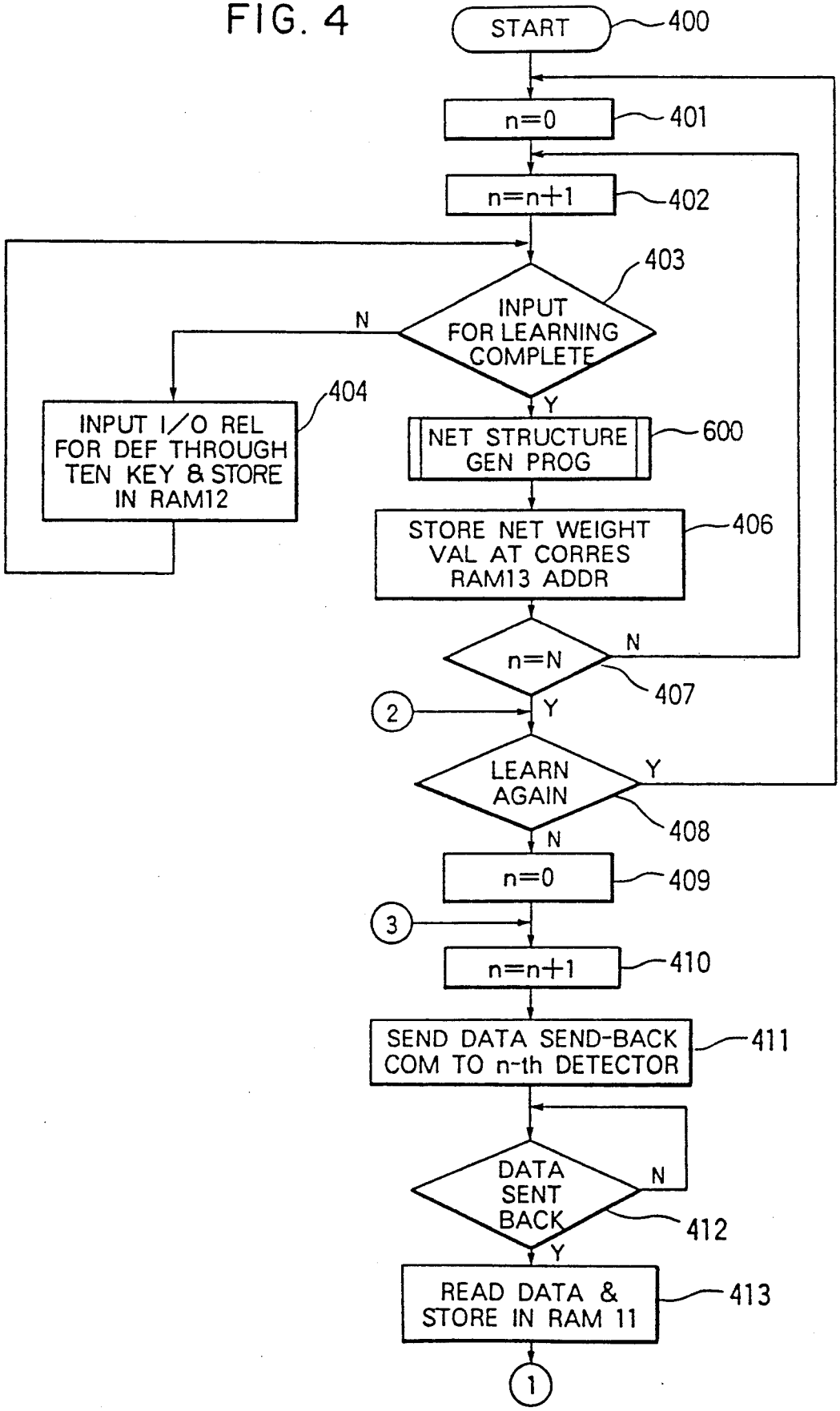
FIG. 4 is a flow chart for illustrating operations of the systems shown in FIG. 1 and FIG. 1A.

Referring to FIG. 4, the net structure generating program is executed sequentially for each of the N fire detectors, starting from the No. 1 fire detector.

Describing the operation of the net structure generating program for the n-th fire detector ($n=1\sim N$), the six sensor levels listed at the upper row and the fire probability at the intermediate row in the definition table described previously by reference to FIG. 2 are first given as the teaching inputs or the inputs for learning through the learning data input ten key KY (step 404). Although a definition table is prepared for each of the fire detectors in view of the fact that the environments where the fire detectors are installed and the characteristics thereof differ from one to another fire detector, it goes without saying that a similar definition table can be used for those fire detectors having similar characteristics and similar environmental conditions.

Figure 6:
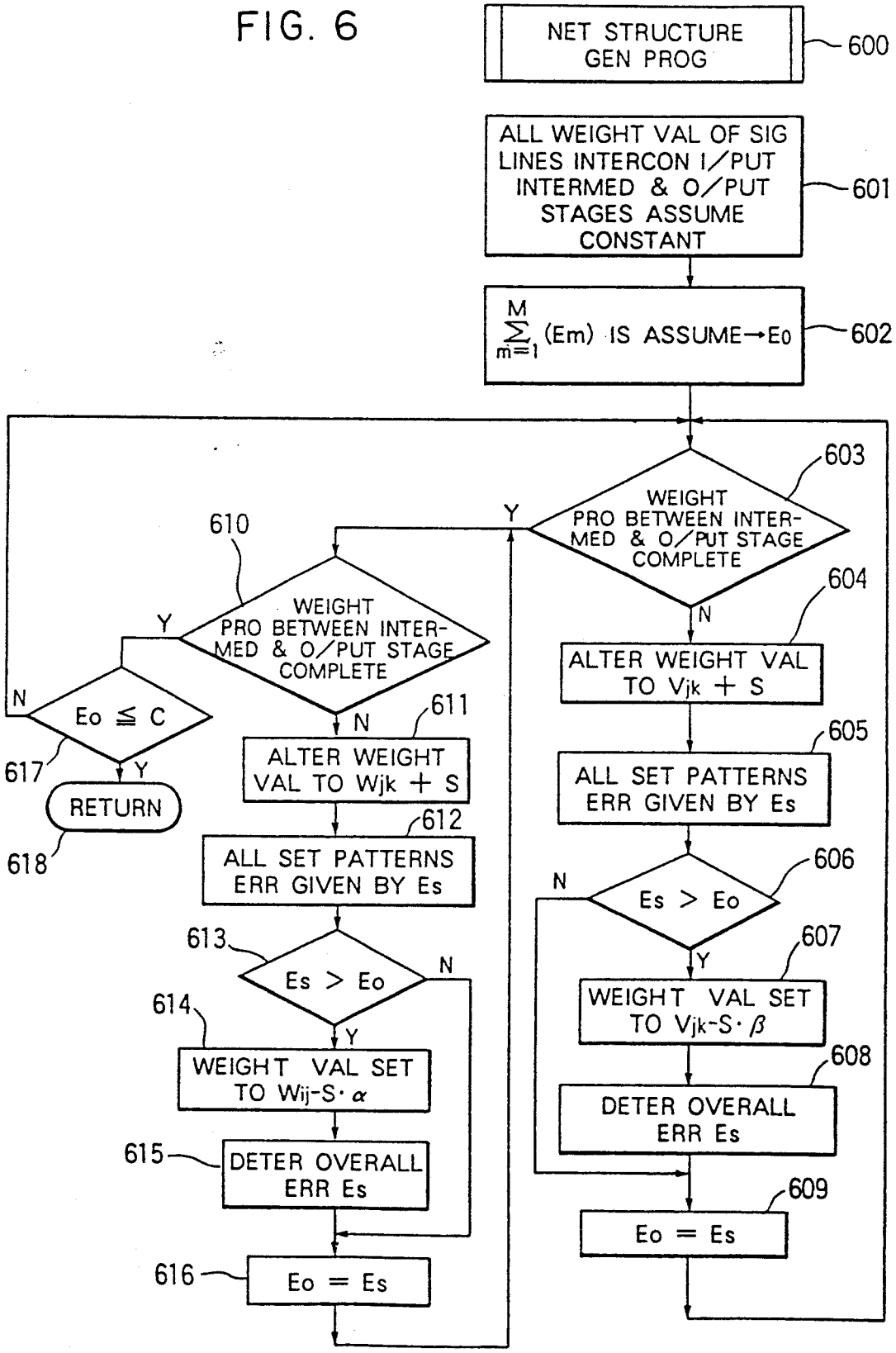
FIG. 6 is a flow chart for illustrating a net structure generating program (weight value adjusting means) shown in FIG. 4.

When the contents of the definition table for the n-th fire detector are stored in the n-th fire detector area provided in the definition table storage area RAM12 through the ten key (when Y results from step 403), then processing proceeds to the execution of the net structure generating program 600 also illustrated in FIG. 6.

In the first place, the weight values Wij and Vik of the twenty-eight signal lines in total, including 24 lines provided between the input stage and the intermediate stage and 4 lines provided between the intermediate stage and the output stage as described hereinbefore in conjunction with FIG. 3, are set at given constant values, respectively, (step 601). Subsequently, on the basis of the weight values set to be constant, the totaled value (E of the expression Eq. 6) of the squares of errors between the output values OT and the teacher output values T are determined in accordance with the previously mentioned expressions Eq. 1 to Eq. 6 for all the M combinations ($M=26$ in the case of the illustrated embodiment) listed in the definition table of FIG. 2, wherein the result as obtained is represented by $E_o$ (step 602).

Next, an operation is performed to adjust one by one the weight values of the four signal lines between the intermediate stage and the output stage so that the overall error value $E_o$ is minimized for inputting the same definition table (N of step 603). Because the adjustment of the weight values is made only for the signal lines extending between the intermediate stage and the output stage, no changes can take place in the values determined in accordance with the expressions Eq. 1 and Eq. 2. At first, the weight value $V_{1\,1}$ of the first one signal line is altered to a weight value of $V_{1\,1}+S$ (step 604) and the calculations are performed similarly in accordance with the expressions Eq. 3 to Eq. 6. The final error value E determined from the expression Eq. 6 is represented by $E_s$ (step 605). Then, the value of $E_s$ is compared with the overall error value $E_o$ before altering the weight value (step 606).

If $E_s \leqq E_o$ (N of step 606), the value $E_s$ is set as a new value of $E_o$ (step 609), while the updated weight value of ($V_{1\,1}+S$) is stored at an appropriate location in the work area.

On the other hand, when $E_s > E_o$ (Y of the step 606), this means that the direction in which the weight value has been changed is erroneous. Accordingly, the weight value is altered in the opposite direction starting from the original weight value $V_{1\,1}$, being then followed by the calculation of $E_s$ by using a weight value of $V_{1\,1}-S\cdot\beta$ in accordance with the expressions Eq. 3 to Eq.

6 (steps 607, 608), wherein the value of $E_s$ thus determined is set as the new value of $E_o$ (step 609), while the altered weight value of $V_{11}-S\cdot\beta$ is stored at an appropriate location in the work area.

It should be mentioned that $\beta$ represents a coefficient proportional to $|E_s-E_o|$ and that S is variable as a function of the number of times the weight value is altered or changed and assumes a smaller value as said number of times increases.

After completion of the alteration and adjustment of $V_{11}$ through the steps 604 to 609, then the alteration and adjustment of the weight values $V_{21}$ to $V_{41}$ for the remaining three signal lines are sequentially performed through the similar processing steps 604 to 609.

Upon completion of the adjustment of the weight values Vjk for all the signal lines extending between the intermediate layer stage and the output stage in this way (Y of the step 603), a similar adjustment is next performed on the weight values Wij for the signal lines between the input stage and the intermediate stage at steps 610 to 616 all in accordance with the expressions Eq. 1 to Eq. 6 so that any error can be minimized.

When the adjustment of the weight values for all the signal lines has been completed (Y of step 610), the value $E_o$ having been reduced in this way is compared with a predetermined value C. When the former is still greater than the value C (N of a step 617), the step 603 is regained for diminishing further the error, wherein the procedure for adjustment of the weight values between the intermediate stage and the output stage through the steps 604 to 609 described above is repeated again. When the value $E_o$ becomes equal to or smaller than the predetermined value C after the repeated adjustment (Y of step 617), the processing proceeds to a step 406 shown in FIG. 4, where the altered and adjusted individual weight values Vik and Wij for the twenty-eight signal lines are stored in the associated n-th fire detector area of the storage area RAM13 at the corresponding addresses, respectively.

Through the operation described above, the values of S, $\alpha$, $\beta$, C, etc. are stored in the storage area ROM12 for the various constants table.

Since the final error value of $E_o$ can not assume zero, the adjustment of the weight values for the signal lines has to be terminal at an appropriate value. In this conjunction, it is noted that in addition to the termination of the adjustment at the time point when $E_o$ becomes equal to or smaller than C, as indicated at the step 617, it is also possible to previously determine the number of times the adjustment of the weight value is to be performed, wherein the adjustment is automatically ended when the said predetermined number of times has been attained.

The values at the lower row "OUTPUT(R)" in each of the patterns numbered indicate the fire probability output from the net structure as OT in response to the six sensor levels $SLV_1 \sim SLV_6$ indicated at the upper row in FIG. 2 and supplied to the net structure as IN, wherein the net structure is so realized as to repeat the adjustment at the steps 603~616 until the expression (Eq. 6) has assumed the following value:

$$E = \sum_{m=1}^{M} (Em) = 0.07655$$

It will be seen from FIG. 2 that the fire probability "OUTPUT(R)" actually output from the net structure approximates very closely the values of "OUTPUT(T)" set initially in terms of the teacher signals. The corresponding weight values for the actually measured values "OUTPUT(R)" of the fire probability are shown in FIG. 8.

Figure 9:
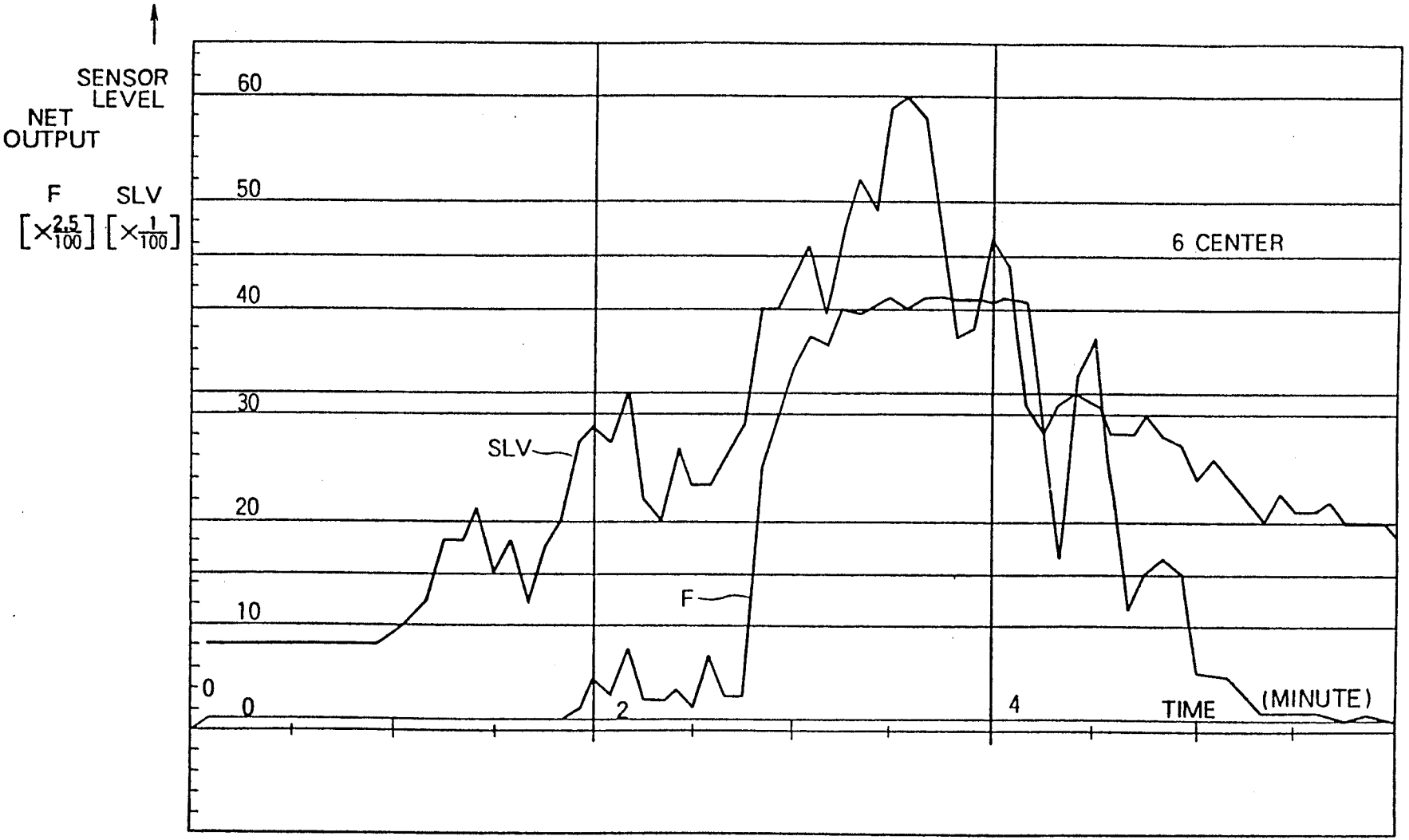
FIG. 9 is a view showing fire probability output from the net structure in response to actual changes in the sensor levels on the assumption that the weight values are established as shown in FIG. 8.

FIG. 9 illustrates graphically the actually measured values of the fire probability output from the net structure upon the input thereto of the real arbitrary values of the sensor levels varying from time to time in addition to the specific patterns of the six sensor levels, wherein time is taken along the abscissa while there is taken along the ordinate the sensor level SLV varying from time and the fire probability F output from the net structure.

By defining the time-serial input information values of the six sensors and the fire probability serving as the teacher signal in terms of twenty-six patterns in the manner mentioned above, those combinations of the sensor outputs which are not contained in the definition table can also be determined through interpolation by the net structure, whereby the optimum output is produced as the indication or answer. In the case of the instant embodiment, it is assumed that the numbers of the inputs and the outputs to and from the net structure are six and one, respectively. However, it can readily be understood by those skilled in the art that the sensor input number as well as the sensor output number can be increased or decreased, as occasion requires. Besides, there may be conceived as the output information a variety of combinations inclusive of the probability of there being no fire, visibility or see-through distance, walking speed, probability of fire extinguishing and others.

When the adjustment of the weight values for the signal lines has been performed for all of the N fire detectors incorporated in the fire alarm system (Y of a step 407) and when it is decided that there is no necessity for the repeated learning (N of step 408), then the fire monitoring operation of the fire detectors is activated sequentially, starting from the first fire detector.

Describing the fire monitoring operation in connection with the n-th fire detector DEn, a data send-back command for the n-th fire detector DEn is sent out onto the signal line L from the signal transmission/reception part TRX1 through the interface IF11 (step 411).

Upon reception of the send-back command by the n-th fire detector DEn, the latter reads through the interface IF21 the sensor level (based on such physical quantities as smoke, heat or gases) detected by the sensor part, i.e. the fire phenomenon detecting means FS and converted into digital quantities by means of the incorporated analogue-to-digital converter with the aid of a program stored in the program storage area ROM21 and sends out the sensor level from the signal transmission/reception part TRX2 through the interface IF22.

Upon reception of the send-back data from the sensor part of the n-th fire detector DEn (Y of a step 412), the sensor levels as sent back are stored in the work area RAM11 (step 413).

In the work area RAM11, areas are allocated for storing a plurality of sensor levels for the individual fire detectors, respectively, so that the sensor levels sent back from the fire detectors upon every polling are held for a predetermined time with the oldest data or sensor level being discarded. For example, assuming that the period taken for polling each of the fire detectors $DE_1 \sim DE_N$ is five seconds with the abovementioned predetermined period thus being twenty-five seconds, then the sensor levels obtained through six times of polling are constantly stored for each of the fire detectors.

Figure 7:
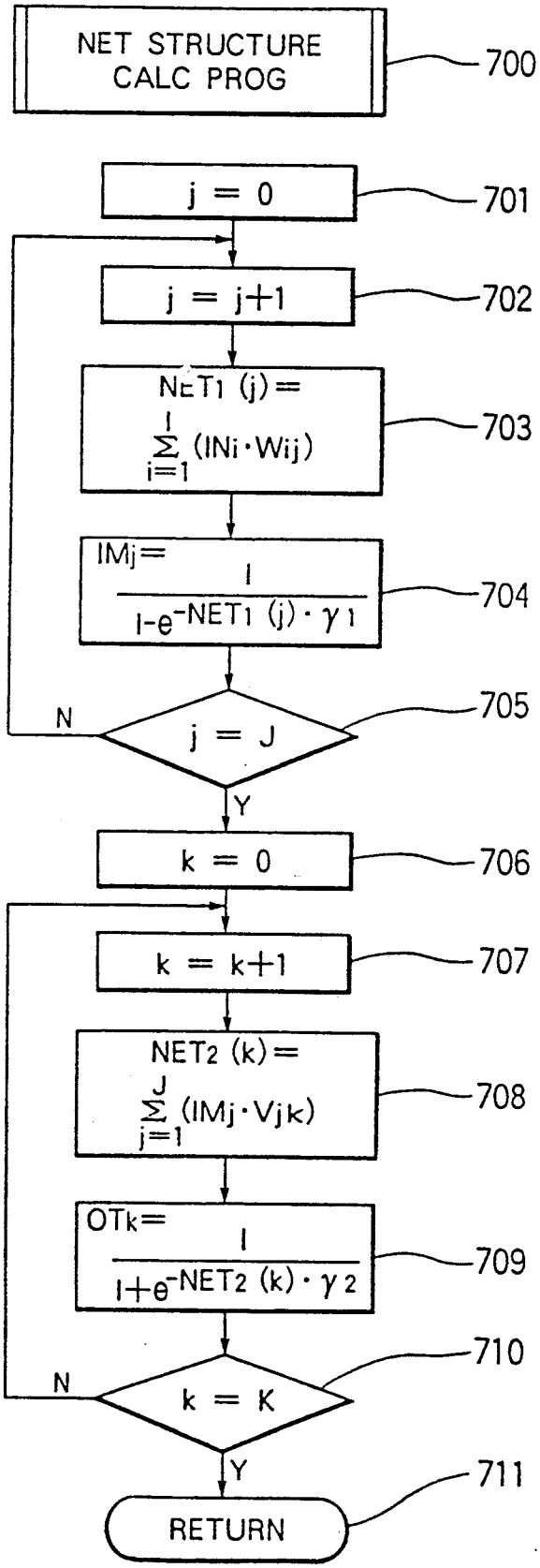
FIG. 7 is a flow chart for illustrating the net structure calculation programs shown in FIG. 5 and FIG. 5A.

When the sensor level sent back from the n-th fire detector DEn is stored at the area assigned to the n-th fire detector of the work area RAM11 with the oldest data being discarded (step 413), then the six sensor levels stored in the area assigned to the n-th fire detector are converted, respectively, to the numerical values INi (where $i=1\sim6$) in the range of "0" to "1" to be input to the net structure calculation program (step 414), wherein the net structure calculation program 700 shown in FIG. 7 is executed.

Figure 5:
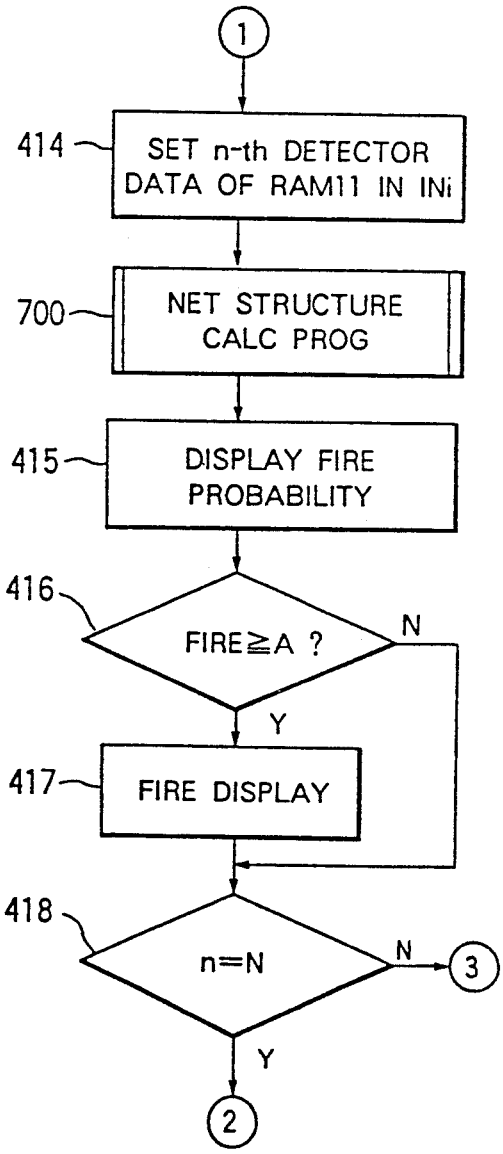
FIG. 5 and FIG. 5A are flow charts for illustrating operations of the systems shown in FIG. 1 and FIG. 1A, respectively.

Through the net structure calculation program 700, $NET_1$ (j) is arithmetically determined in accordance with the expression Eq. 1 mentioned hereinbefore (step 703), the resulting value then being converted into the value IMj in accordance with the expression Eq. 2 (step 704). When the IMj value is determind for all $IM_1$ to $IM_J$ (where $J=4$) (Y of step 705), then $NET_2$ (k) is calculated by using the value of IMj in accordance with the previously mentioned expression Eq. 3 (step 708), the values resulting from the calculation then being converted into the values of OTk (where $k=1\sim K$) (step 709). When the value of OTk, i.e. the value of the fire probability $OT_1$ has been determined (Y of a step 710), the processing illustrated in the flow chart of FIG. 5 is regained. Now, referring to FIG. 5, the value of $OT_1$ is displayed, as it is, as the fire probability (step 415) and compared with the reference value A of the fire probability read out from the various constant table storage area ROM12 (step 416). When $OT_1 \geqq A$, the fire indication is activated (step 417).

Through the procedure described above, the fire monitoring operation for the n-th fire detector comes to an end, wherein a similar fire monitoring operation is performed for the next fire detector.

Although it has been described in conjunction with the above embodiment that the data is artificially input to the definition table storage area RAM12 to thereby allow the weight values to be stored in the storage area RAM13 on the basis of the input data through the net structure generating program, it is equally possible to determine the weight values by using the net structure generating program at a manufacturing stage in a factory and store the weight values in a ROM such as an EPROM or the like, the ROM being then incorporated in the system.

In place of the analogue type fire alarm system described above in conjunction with the exemplary embodiments, the present invention is also applicable to an on/off type fire alarm system in which the decision concerning the fire is performed at each of the individual fire detectors, wherein only the result of the decision is supplied to the receiving means such as the fire control panel, repeater or the like. In that case, the ROM11, ROM12 and ROM13 shown as incorporated in the fire control panel in FIG. 1 will be disposed in each of the fire detectors. Further, it is preferred that a ROM loaded with the weight values at a manufacturing stage in a factory as mentioned above be incorporated in each of the fire detectors in place of RAM12 and RAM13 in consideration of the fact that no space is available in the fire detector for providing the ten key and others shown in FIG. 1 for inputting the data in the RAM12. In that case, the steps 401~408 shown in FIG. 4 would be executed by a signal processing apparatus installed at the factory, wherein the weight values would be stored in the EPROM at step 406, the EPROM then being mounted on the fire detector. For the fire detector, the processing including step 409 shown in FIG. 4 to step 418 in FIG. 5 is executed.

In the following, a description will be made of another preferred embodiment of the present invention by referring to FIGS. 1A, 2, 2A, 3, 3A, 3B, 4, 5A, 6 and 7.

At first, it should be mentioned that those drawings showing the second exemplary embodiment that are the same type as those referred to in the description of the first embodiment are labeled with the same figure numbers as those used in conjunction with the first embodiment but with a suffix of A or B. Further, since FIGS. 2, 3, 4, 6 and 7 remain the same as in the case of the first embodiment, these figures are referred to as they are, without being suffixed with an A or B.

Figure 1A:
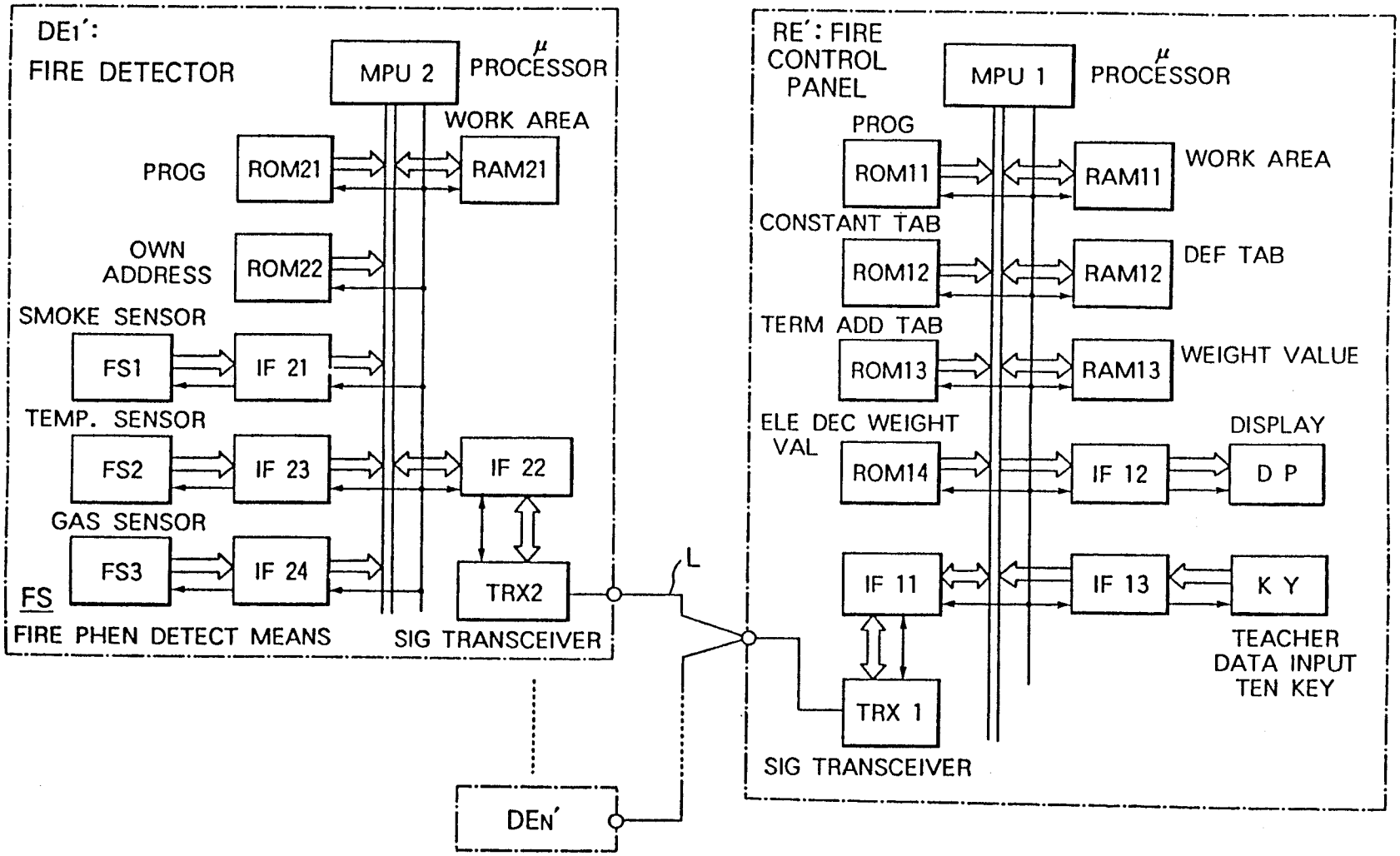

FIG. 1A shows in a block circuit diagram a so-called analogue type fire alarm system to which the present invention is applied and in which sensor levels representing the physical quantities produced by the fire phenomena and detected by the individual fire detectors are sent to a receiving means such as a control panel, repeater or the like, wherein the receiving means is adapted to make the decision concerning the occurrence of a fire on the basis of the sensor levels as collected. Of course, it goes without saying that the invention can equally be applied to an on/off type fire alarm system in which the fire decision is performed at the individual fire detectors with only the results of the decision being sent to the receiving means.

In FIG. 1A, reference character RE' denotes a fire control panel, and $DE_1'$ to $DE_N'$ designate N analogue type multi-element fire detectors connected to the fire control panel RE' by way of a transmission line L which may be constituted, for example, by a pair of conductors serving for the electric power supply and the signal transmission, in which only one of the fire detectors is illustrated in detail in respect to the internal circuit configuration. Parenthetically, it should be mentioned that not all of N fire detectors are necessarily multi-element fire detectors and a plurality of different types of fire detectors may be combined to form one multi-element fire detector. Accordingly, with the expression "n-th fire detector ($n=1-N$)" used in the following description, it is intended to cover both single multi-element fire detectors and a set including a plurality of different types of single-element fire detectors.

The fire control panel RE' has a structure corresponding to that of the fire control panel RE shown in FIG. 1 except that a storage area ROM14 for storing the weight values for constituent or elementary decisions and the weight value storage area RAM13 are to serve as a storage area RAM13 for storing the weight values for the overall decision or judgment. The other fire control panels RE' are of an identical structure to that of the fire control panel RE shown in FIG. 1. Accordingly, repeated description of the these control panels RE' will be unnecessary. The storage area ROM14 for storing the weight values for the constituent or elementary decision serves to store therein for all the fire detectors the weight values of the signal lines described hereinafter for the purpose of obtaining the fire information values from each of the individual sensors incorporated in each fire detector. On the other hand, the storage area RAM13 for storing the weight values for overall decision or judgment serves to store therein for all the fire detectors the weight values provided for the overall decision, as described hereinafer, for the purpose of deriving the overall fire information value on the basis of the individual fire information values obtained from each of the elementary or constitent sensors incorporated in each of the fire detectors.

Further, in the case of the multi-element fire detector $DE_1'$, the fire phenomenon detecting means, i.e. the sensor part FS, is not of the single element structure but is implemented as a fire phenomenon detecting means adapted for detecting a plurality of physical quantities, i.e. a multiplicity of elementary quantities such as heat, smoke, gas and the like attributable to the fire phenomenon and may comprise a smoke sensor part $FS_1$ which may be of a scattered light type, by way of example, a temperature sensor part $FS_2$ which may include, for example, a thermistor, a gas sensor part $FS_3$ which may include, for example, a gas detecting element, together with interfaces IF23 and IF24 provided in association with the sensor parts mentioned above. The remaining structure of the multi-element fire detector $DE_1'$ is the same as that of the fire detector $DE_1$ shown in FIG. 1 and thus description thereof will be omitted. Each of the sensor parts $FS_1$, $FS_2$ and $FS_3$ include components such as an amplifier, a sampling and hold circuit, an analogue-to-digital converter, etc. which are not shown in the drawings.

Although the first multi-element fire detector $DE_1$ is shown in FIG. 1A as incorporating three sensor parts which are to serve as the fire phenomenon detecting means, it should be understood that the invention is not limited to the number and the types of the sensor parts as shown but the number and the types of the sensor parts may vary from one to another multi-element fire detector. Besides, in the case of a set in which a plurality of fire detectors are employed, the number and types of fire detectors combined as a set can be altered, as occasion requires.

Preceding the concrete description of operation of the second embodiment of the present invention with the aid of FIGS. 4, 5A, 6 and 7, description will first be directed to the underlying concept.

With the second embodiment of the invention, it is contemplated to collect time-serially a plurality of sensor levels from the individual sensors of plural sensor parts of the multi-element fire detector (or of plural fire detectors in case the multi-element fire detector is constituted by a set of fire detectors) which are, respectively, adapted to detect different types of physical quantities inherent to the fire phenomenon, to thereby obtain rapidly and correctly various information about a fire such as fire probability and the degree or level of danger on the basis of all the sensor levels as collected. More specifically, as the plurality of time-serial sensor levels, the sensor level of each sensor part is sampled every fifth second over a period of twenty-five seconds to thereby obtain the six sensor level samples in total. On the basis of these sensor level samples, a fire decision as to a fire is made at each of the sensor parts, being then followed by the synthetic decision made on the basis of the fire information obtained from the individual sensor parts, to thereby derive more reliable fire information, as will be described hereinafter by reference to FIGS. 2, 2', 2A, 3A, 3 and 3B.

Figure 3A:
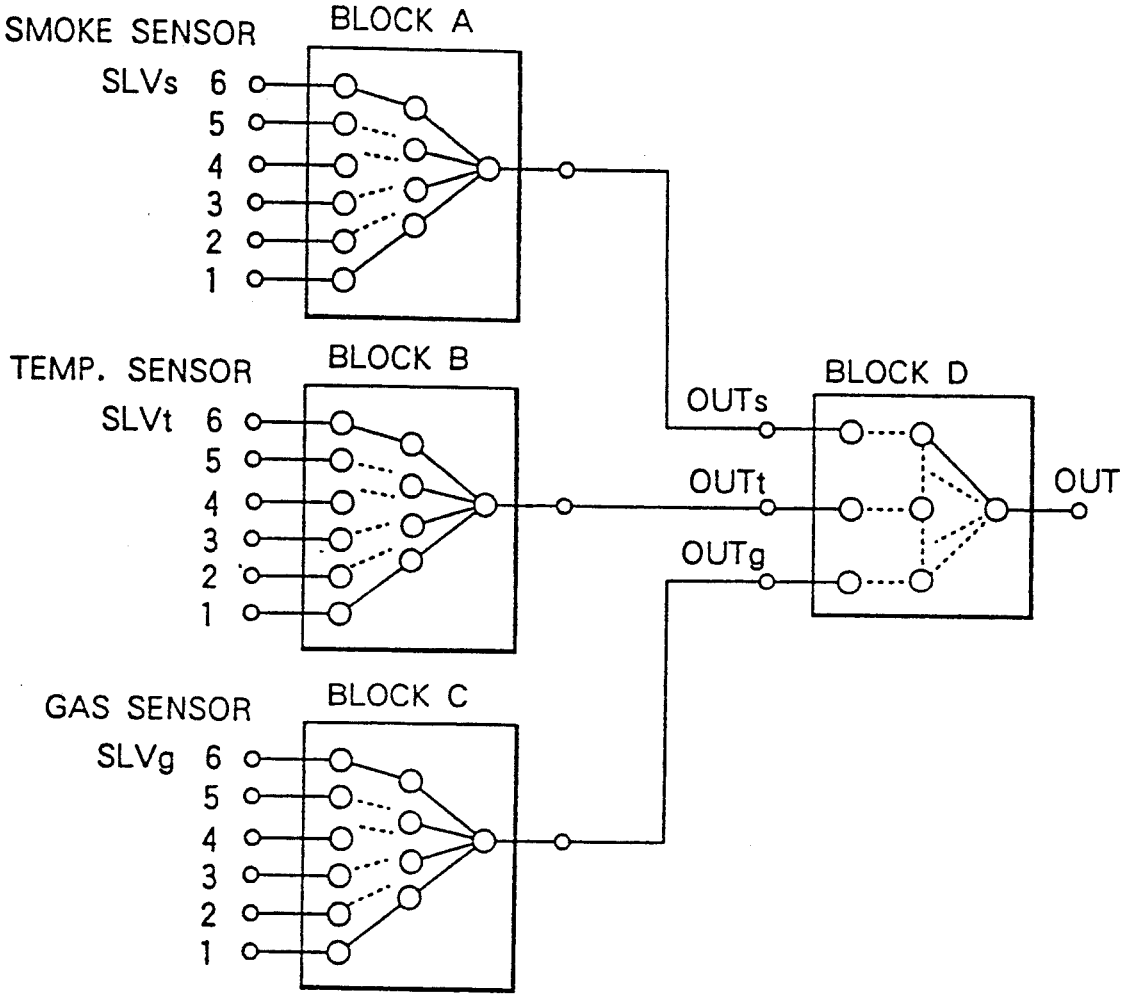

Before entering into description of the operation outlined above, a net structure such as shown in FIG. 3A will be looked at. The network structure shown in FIG. 3A is assumed to be incorporated in the fire control panel RE' in a number corresponding to the multi-element fire detectors $DE_1' \sim DE_N'$, respectively. In the net structure shown in FIG. 3A, a block A is assumed to be provided in association with a smoke sensor $FS_1$, a block B is assumed to be provided in association with a temperature sensor $FS_2$, a block C is assumed to be provided in association with a gas sensor $FS_3$, and a block D is assumed to be provided for receiving the outputs from the blocks A~C to thereby output one fire probability signal on the basis of the synthetic decision or judgment of the outputs of the blocks A~C. Inputted to the block A, B and C are six time-serial smoke sensor levels $SLV_{s1} \sim SLV_{s6}$, temperature sensor levels $SLV_{t6} \sim SLV_{tb}$ and gas sensor levels $SLV_{g1} \sim SLV_{g6}$, respectively, which are collected by the fire control panel RE' from the sensor parts $FS_1$, $FS_2$ and $FS_3$ of the associated multi-element fire detector. In response to these inputs, the blocks A, B and C output the fire probability signals $OUT_s$, $OUT_t$ and $OUT_g$, respectively. These fire probability signals are input to the block D which then judges synthetically the input fire likelihood signals to output a more reliable fire probability with very high accuracy.

In the case of the second embodiment of the invention, it is assumed that the blocks A~C are previously prepared for each fire detector already at a manufacturing stage and stored in the storage area ROM14 for the weight values for the element decision. According to a method of preparing, for example, the block A for the smoke sensor, the weight values of the signal lines are adjusted on a line-by-line basis in accordance with the expressions Eq. 1 to Eq. 6 mentioned hereinbefore with the aid of the net generating program illustrated in FIG. 6 by using the definition table shown in FIGS. 2, 2' and described before in conjunction with the first embodiment of the invention. The other blocks B and C can be prepared in a similar manner by adjusting the weight values of the relevant signal lines on a line-by-line basis in accordance with the expressions Eq. 1~Eq. 6 through the net creating rogram by preparing the definition tables for the temperature sensor and the gas sensor, respectively. In this case, the sensor level obtained by the smoke sensor part $FS_1$ is converted to a numerical value in a range of "0" to "1" which correspond to a smoke concentration of 0%/m~20%/m, by way of example. The sensor level obtained from the temperature sensor part $FS_2$ is converted into a numerical value in a range of "0" to "1" corresponding to a temperature range of 0° C.~64° C. And, the sensor level obtained from the gas sensor part $FS_3$ is converted into a numerical value in a range of "0" to "1" which may correspond to a concentration of carbon monooxide (CO) in a range of 0 ppm~200 ppm.

When the teach-in procedure of the definition table such as shown in FIGS. 2, 2' for the net structure of the blocks A~C is completed, i.e. upon completion of the weight value adjustment on the line-by-line basis, these weight values are then stored in the area of the storage area ROM14 assigned to the associated fire detector at a manufacturing stage, for example, to be utilized in the fire monitoring operation described hereinafter.

Next, description will be directed to the teach-in procedure for the net structure shown in FIG. 3A for the block D. As shown in detail in FIG. 3B, the net structure for the block D is so implemented that it has three layers at the input stage, three layers at an intermediate stage and one layer at the output stage, where nine signal lines extend between the input stage and the intermediate stage while three signal lines extend between the intermediate stage and the output stage. Inputted to input layers $IN_1$, $IN_2$ and $IN_3$ are the fire probabilities $OUT_s$, $OUT_t$ and $OUT_g$ output from the blocks A, B and C, respectively, whereby the fire probability decided more strictly is output from the output stage $OT_1$.

Referring to FIG. 2A, there is shown a definition table for teaching the net structure for the block D. Shown in three left columns of the definition table are nine combination patterns of particular values of the output $OUT_s$ from the net structure for the smoke sensor part, the output $OUT_t$ from the net structure for the temperature sensor part and the output $OUT_g$ from the net structure for the gas sensor part, while shown at one right column are the accurate fire probabilities which are determined experimentally for the abovementioned patterns, respectively.

Figure 3B:
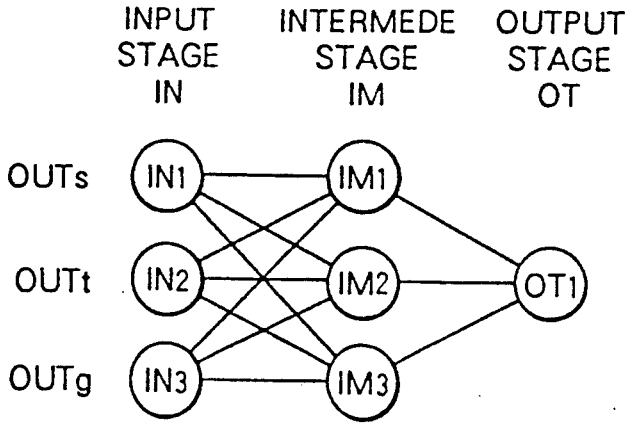

The net structure shown in FIG. 3B may be prepared, for example, in the field, by adjusting the weight values on the basis of the contents of the definition table shown in FIG. 2A in accordance with the expressions Eq. 1~Eq. 6 with the aid of the net creating program shown in FIG. 6 in such manner as described hereinbefore, whereon the adjusted weight values are stored in the storage area RAM13 for the weight values for synthetic decision shown in FIG. 1 (at the step 406 in FIG. 4) to be utilized subsequently in the fire monitoring operation.

As will be appreciated from the above description, the net structure is created by teaching the definition table. In this conjunction, it should be noted that the creation of such net structure may be performed by inputting the definition table in the fire control panel RE', for example, of the fire alarm system installed in the field or alternatively the weight values may be determined with the aid of the net structure creating program at a manufacturing stage in a factory or some other place and stored in a ROM such as an EPROM or the like, wherein the ROM is employed in the system. In the case of the instant embodiment, it is assumed that the weight values for the net structures of the blocks A~C are previously determined and stored in a ROM while the weight values for the net structure of the block D are determined in situ or in the field with the aid of the net structure creating program.

The above description has been made on the assumption that the number of information values input to the input stages of the net structure A~C is six with only one information value output from the output stage, while in the case of the net structure D, the number of information values input to the input stage is three with only one information value output from the output stage. However, it will be readily understood that the numbers of these input and output information values can arbitrarily be selected, as occasion requires. As the information output from the output stage, there can be mentioned in addition to the fire probability various information values such as degree of danger, concentration or density of smoke, visibility or see-through distance and others.

When the net structures A~D shown conceptually in FIG. 3A have been prepared by storing in the storage area ROM14 and the RAM13 the weight values adjusted on the line-by-line, basis through teaching of the definition tables shown in FIGS. 2, 2 and FIG. 2A, the six sensor levels sampled time-serially throughout the period of 25 seconds for each of the sensor parts $FS_1$~$FS_3$ through the net structure calculation program described hereinbefore are supplied to the input stages of each of the net structures A~C, respectively, in the actual fire monitoring operation, whereon the values $OUT_s$, $OUT_t$ and $OUT_g$ obtained from the output stage $OT_1$ are arithmetically determined by using the corresponding weight values in accordance with the expressions Eq. 1~Eq. 4, the values thus determined being then supplied to the input stage of the net structure D to obtain finally the fire probability OUT similarly in accordance with the expressions Eq. 1~Eq. 4 by using the corresponding weight values.

Figure 5A:
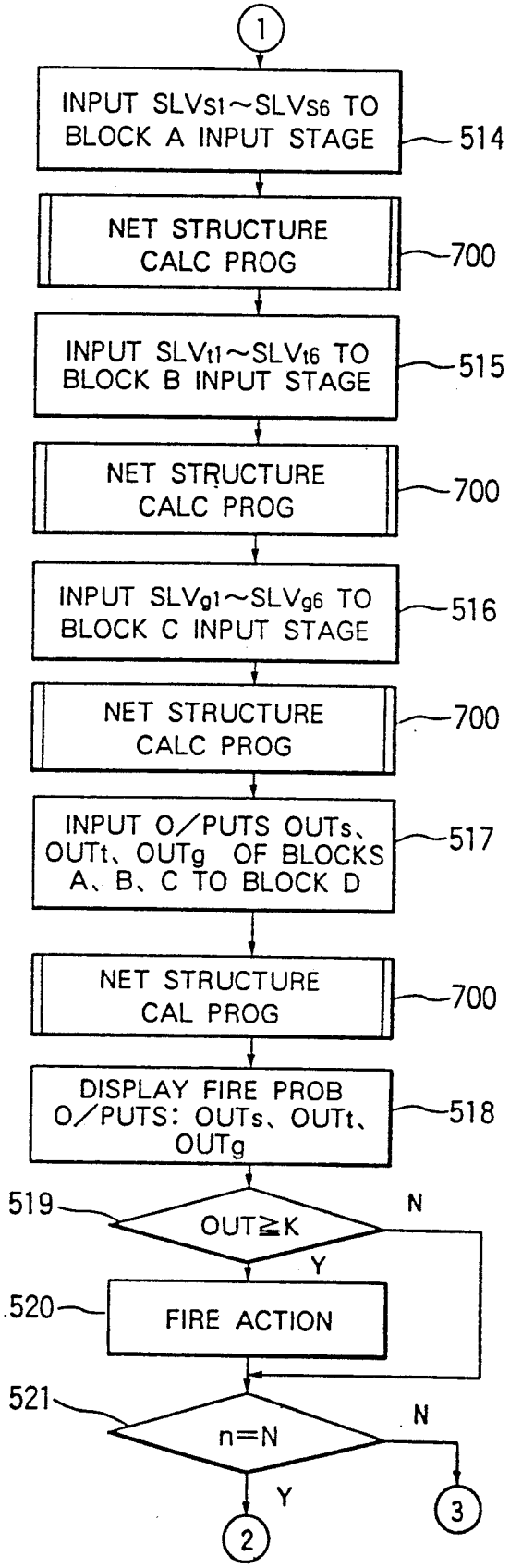

More specifically, referring to FIG. 4, FIG. 5A and FIG. 7, in succession to the step 409 shown in FIG. 4, the fire monitoring operation is performed sequentially, starting from the first fire detector. Describing the fire monitoring operation in connection with the n-th fire detector $DE_n'$, a data send-back command is first sent out onto the signal line L through the interface IF11 from the signal transmission/reception part TRX1 to the n-th fire detector $DE_n'$ (step 411).

Upon reception of the data send-back command by the n-th fire detector $DE_n'$, the fire detector $DE_n'$ which is assumed to be a multi-element fire detector fetches therein through the interfaces IF21, IF23 and IF24, respectively, the sensor levels detected by the sensor parts $FS_1$, $FS_2$ and $FS_3$ on the basis of the physical quantities such as of smoke, heat, gas and others inherent to a fire phenomenon and converted into digital quantities by the incorporated analogue-to-digital converter, wherein these sensor levels are sent back en bloc from the signal transmission/reception part TRX2 through the interface IF22. In case the fire detecting means is constituted by a set of plural fire detectors, the fire control panel RE' collects the sensor levels from the plurality of fire detectors of the set to thereby make the fire decision on the basis of the collected sensor levels. For the data acquisition of this kind, a conventional polling technique can be adopted. It is also possible to use the systems described in the specifications of the undermentioned patent applications 1)~3) filed in the name of the same inventor and applicant as those of the present application.

1) In Japanese Patent Application SHO 63-168986 filed on Jul. 8, 1988 under the title "Fire Alarm Equipment", there is described a system in which a start address is assigned to a first one of fire phenomenon detecting parts, i.e. plural sensor parts of a multi-element fire detector, while the remaining fire phenomenon detecting parts are assigned with associative addresses associated with the start address, wherein in response to a data send-back command issued by a fire control panel to a given one of the addresses, the fire phenomenon detecting part corresponding to that address sends the data as detected to the fire control panel.

2) In Japanese Patent Application SHO 63-201861 filed on Aug. 15, 1988 under the title "Fire Alarm Equipment", there is described a system in which a receiving part, i.e. the fire control panel stores information of the type of one or a plurality of sensor parts of fire phenomenon detecting parts incorporated in each fire detector in correspondence relation with the latter, wherein upon collection of the fire monitoring information from the individual fire detectors, address signals of the fire detectors to be polled are sent out together with the type information corresponding to the fire monitoring information required for these type information of the fire detector(s), and wherein the fire detector responds to the reception of the type information sent thereto through the polling from the fire control panel to thereby send out the fire monitoring information available from the fire phenomenon detecting part designated by the abovementioned corresponding type information.

3) In Japanese Patent Application SHO 63-209356 filed on Aug. 25, 1988 under the title "Fire Alarm Equipment", there is described a system in which each of fire detectors is provided with type information of fire phenomenon detecting parts incorporated in the fire detector as set by first means and sends out one or a plurality of type information in response to a first type information request issued by a control panel, the sequence of the species information as sent out being stored, wherein in response to the request for fire monitoring information from the control panel, individual fire monitoring information obtained from one or a plurality of fire phenomenon detecting parts is sent out in the sequence as stored, while the control panel first stores therein the type information received from the fire detectors in the receiving order in correspondence with the addresses of the fire detectors, and wherein upon reception of the fire monitoring information from the fire detector, decision is made as to which of the fire phenomenon detecting parts the fire monitoring information as received originates by collating the receiving order of the received fire monitoring information with the abovementioned stored type information.

Referring back to the present invention, data sent from the n-th fire detector $DE_n'$, if any, (Y of step 412) is stored in the work area RAM11 (step 413).

The work area RAM11 includes areas for storing the plurality of sensor levels for each of the fire detectors, wherein the area for each of the fire detectors is so segmented or partitioned that the sensor levels of the plural constituent sensor parts sent back from the fire detector upon every polling can be stored for a predetermined time. More specifically, since it is assumed in the case of the instant embodiment that the single polling period for the fire detectors $DE_1' \sim DE_N'$ by the fire control panel RE' is five seconds with the abovementioned predetermined time period being twenty-five seconds and that the sensor levels obtained through six pollings from each element sensor part is to be stored, the area provided in the work area RAM11 for the n-th fire detector $DE_n'$ which is assumed to include three element sensor parts $FS_1$, $FS_2$ and $FS_3$ stores constantly therein the sensor levels $SLV_{s1} \sim SLV_{s6}$, $SLV_{t1} \sim SLV_{t6}$ and $SLV_{g1} \sim SLV_{g6}$, i.e. eighteen sensor levels in total obtained through six pollings of the three element sensor parts, respectively. In that case, the oldest sensor level of each element sensor part is discarded every time a new sensor level is sent back upon polling.

When the data sent back from the n-th fire detector $DE_n'$, i.e. the three sensor levels from the individual element sensor parts, have been stored in the area for the n-th fire detector provided in the work area RAM11 with the oldest data being discarded (step 413), the six sensor levels $SLV_{s1} \sim SLV_{s6}$, $SLV_{t1} \sim SLV_{t6}$ and $SLV_{g1} \sim SLV_{g6}$ of the individual element sensor parts stored in the n-th fire detector area are converted into numerical values INi ($i=1 \sim 6$) in a range of "0" to "1", respectively, to be subsequently input to the net structures A~C shown in FIG. 3A, whereon the execution of the net structure calculation program 700 shown in FIG. 7 is activated.

At first, when the sensor levels $SLV_{s1} \sim SLV_{s6}$ originating in the smoke sensor $FS_1$ are input to the net structure A shown in FIG. 3A (step 514), the net structure calculation program 700 calcuates $NET_1$ (j) in accordance with the expression Eq. 1 mentioned hereinbefore (step 703), the result of which is converted to the IMj value in accordance with the expression Eq. 2 (step 704). When the IMj values have been determined for all $IM_1 \sim IM_j (J=4)$ (Y of step 705), then $NET_2$ (k) is calculated on the basis of the IMj values in accordance with the expression Eq. 3 mentioned hereinbefore (step 708), the result of which is converted to the value of OTk in accordance with the expression Eq. 4 (step 709). Upon determination of OTk (k=1 in the case of the instant embodiment), i.e. upon determination of the output OUTs of the net structure A (Y of step 710), return is made to the flow chart shown in FIG. 5, whereon the sensor levels $SLV_{t1} \sim SLV_{t6}$ of the temperature sensor part $FS_2$ are then supplied to the net structure B (step 515). Similarly, the output OUTt is determined by the net structure calculation program 700 through the same procedure as described above, and the sensor levels $SLV_{g1} \sim SLV_{g6}$ from the gas sensor part $FS_3$ are then supplied to the net structure C (step 516), whereby the output OUTg is determined by the net structure calculation program 700.

When the outputs OUTs, OUTt and OUTg from the net structures A, B and C, respectively, have thus been determined, these outputs are then supplied to the net structure D shown in FIG. 3B as well (step 517), whereon the net structure calculation program 700 is executed in a similar manner as described above. Thus, the fire probability ratio OUT is obtained as the final output from the output stage $OT_1$ of the net structure D.

Next, the fire probabilities OUT, OUTs, OUTt and OUTg as obtained are displayed on the display unit DP through the interface IF12 (step 518), while the final fire probability OUT is compared with the reference value K of the fire probability which is read out from the various constant table storage area ROM12 (step 519). When OUT≧K, appropriate fire operations measures such as fire display or fire alarm are taken (step 520).

Now, as the fire monitoring operation for the n-th fire detector has been completed, similar fire monitoring operations are performed for the next fire detector.

In the case of the embodiment of the invention described above, the first net structures are provided in correspondence with the plural element sensors, respectively, wherein the plural sensor levels collected time-serially from the individual element sensor parts are supplied to the corresponding first net structures, respectively, to obtain the respective fire decision information values, which are again supplied to the second additional net structure to thereby obtain the final fire decision information value. It should, however, be appreciated that, instead of providing the net structures in correspondence with the individual element sensors, respectively, only one net structure may be provided for the whole system, wherein all the plural sensor levels obtained time-serially from the plurality of the element sensor parts may be input to only one net structure to derive the fire decision information value based on the synthetic judgment.

Further, in place of collecting the time-serial plural sensor levels from all the constituent sensor parts, it is equally possible to collect time-serially the plural sensor levels from at least one constituent sensor part while collecting only one sensor level from the remaining element sensor parts, wherein these sensor levels are supplied to the second net structure by way of respective first net structures or to the only one net structure provided for the whole system for thereby obtaining the fire decision information.

Although it has been assumed in the foregoing that the plurality of fire phenomenon detecting means are of mutually different types, it should be appreciated that the plurality of fire phenomenon detecting means may be of a same type installed at different locations (in a same room or zone). In that case, the definition table shown in FIG. 2A is so prepared that various fire decision values are derived from the outputs of the same type sensor parts.

It should be added that in the case of the embodiment of the invention, the net structures of the blocks A~C shown in FIG. 3A are created at a manufacturing stage in a factory and the weight values for the net structures are stored in the weight value storage ROM14 for the element decision such as an EPROM or the like, while only the net structure for the block D shown in FIG. 3A is generated by executing the net structure creating program with the weight value for the overall or synthetic decision being stored in the storage area RAM13. It should, however, be appreciated that the weight values of all the net structures for all the blocks A~D may be stored in the storage RAM13 through the net structure creating program after the installation of the fire detector or reversely all the net structures may be previously created in manufacturing steps in a factory for allowing a ROM such as an EPROM storing the weight values for these net structures to be employed, as will readily be apparent for those skilled in the art.

Besides, in lieu of the analogue type fire alarm system described above in conjunction with the exemplary embodiments, the present invention is also applicable to an on/off type fire alarm system in which the decision concerning a fire is performed on the side of the individual fire detectors, wherein only the result of the decision is supplied to the receiving means such as a fire control panel, repeater or the like. In that case, the ROM11 and ROM12 shown as incorporated in the fire control panel in FIG. 1A are disposed in each of the fire detectors. Further, it is preferred that a ROM loaded with the weight values at a manufacturing stage in a factory as mentioned above is incorporated in each of the fire detectors in place of the ROM14, RAM12 and RAM13 in consideration of the fact that no room is available in the fire detector for providing the ten key and others shown in FIG. 1 or FIG. 1A for inputting the data in the RAM12.

I claim:

1. A fire alarm system for receiving detection information values generated by at least one fire phenomenon detecting device and for subjecting the detection information values to signal processing for obtaining a value denoting at least one type of fire related information, said fire alarm system comprising:

detection information collecting means for time-serially collecting a plurality of detection information values generated by said at least one fire phenomenon detecting device; and signal processing means for signal processing the plurality of the detection information values time-serially collected by said detecting information collecting means by respectively assigning weighting coefficients to each input detection information value in accordance with a relative significance thereof to said fire related information, altering each detection information value in accordance with a weighting coefficient assigned thereto, and arithmetically determining said fire related information value on the basis of the thus altered detection information values.

2. A fire alarm system for signal processing detection information values generated by a plurality of fire phenomenon detecting devices to obtain a value denoting at least one type of fire related information, said fire alarm system comprising:

detection information collecting means for collecting detection information values from each of said fire phenomenon detecting devices, wherein a plurality of detection information values from at least one of said fire phenomenon detection devices is time-serially collected; and signal processing means for signal processing said detection information values collected by said detecting information collecting means by respectively assigning weighting coefficients to each input detection information value in accordance with a relative significance thereof to said fire related information, altering each detection information value in accordance with a weighting coefficient assigned thereto, and arithmetically determining said fire related information values on the basis of the thus altered detection information values.

3. A fire alarm system as set forth in claim 2, wherein said signal processing means includes first auxiliary processing means associated with said at least one fire phenomenon detecting device by which said plural detection information values are time-serially collected, for performing an arithmetic operation to obtain individual fire information values, and second auxiliary processing means for processing the individual fire information values input from said first auxiliary processing means and the detection information values input from the remaining fire phenomenon detecting devices in which detection information values are not time-serially collected, to thereby derive final fire related information values of higher reliability.

4. A fire alarm system for obtaining a value denoting at least one type of fire related information by processing signals representative of detection information generated by a plurality of fire phenomenon detecting devices, comprising:

detection information collecting means for time-serially collecting a plurality of detection information values from each of said fire phenomenon detecting devices; and signal processing means for signal processing the detection information values collected by said detection information collecting means, and including means for respectively assigning weighting coefficients to each of said detection information values upon inputting thereof in accordance with an extent to which each input detection information value contributes to said related fire information, altering each detection information value in accordance with a weighting coefficient assigned thereto, and arithmetically determining said fire related information value on the basis of the thus altered detection information values.

5. A fire alarm system as set forth in claim 4, wherein said signal processing means includes first auxiliary processing means associated with said fire phenomenon detecting devices in which said plural detection information values are time-serially collected, for performing an arithmetic operation to obtain individual fire information values, and second auxiliary processing means for processing the individual fire information value input from said first auxiliary processing means to derive final fire related information values of higher reliability.

6. A fire alarm system as set forth in any one of claims 1 to 5, wherein said signal processing means includes storage means for storing in advance the weighting coefficients assigned to the detection information values, respectively, said weighting coefficients being selected to cause the fire related information value arithmetically determined by said signal processing means in response to the inputting of a particular set of the detection information values to approximate a desired fire related information value which is to be derived from said particular set of the information values.

7. A fire alarm system as set forth in any one of claims 1 to 5, further comprising a table having stored therein a particular set of detection information values together with at least one fire related information value which is to be obtained when said particularly set of detection information values is input, adjusting means for adjusting the weighting coefficients so that said fire related information value arithmetically determined by said signal processing means when said particularly set of detection information values stored in said table is input approximates said fire related information values stored in said table, wherein said signal processing means includes storage means for storing weighting coefficients for said respective detection information values, said weighting coefficients stored in said storage area being first adjusted by said adjusting means on the basis of the contents of said table.

8. A fire alarm system as set forth in claim 3 or 5, further comprising a table for storing therein a particular set of detection information values together with at least one fire related information value which is to be obtained when said particular set of detection information values is input, adjusting means for adjusting the weighting coefficients so that said fire related information value arithmetically determined by said signal processing means when said particular set of detection information values stored in said table is input approximates said fire related information value stored in said table, wherein said signal processing means includes storage means for storing weighting coefficients for the respective detection information values, said weighting coefficients stored in said storage means for said first auxiliary processing means being previously established so that the fire related information value arithmetically determined by said first auxiliary processing means when the particularly set of detection information values for said first auxiliary processing means is input approximates a desired information value which is to be derived from each particular set for said first auxiliary processing means, while the weighting coefficients stored in said storage area for said second auxiliary processing means are initially adjusted by said adjusting means on the basis of the contents of said table.

9. A fire alarm system as set forth in any one of claims 1 to 5, comprising a receiving part and a plurality of fire detectors connected to said receiving part, each of said fire detectors including at least one fire phenomenon detecting means for detecting a physical quantity attributable to a fire phenomenon, wherein said signal processing means is incorporated in said receiving part.

10. A fire alarm system as set forth in any one of claims 1 to 5, comprising a receiving part and a plurality of fire detectors connected to said receiving part, each of said fire detectors including at least one fire phenomenon detecting means for detecting a physical quantity attributable to a fire phenomenon, wherein said signal processing means is incorporated in each of said fire detectors.

11. A fire alarm system as set forth in claim 3 or 5, comprising a receiving part and a plurality of fire detectors connected to said fire receiving part, each of said fire detectors including at least one fire phenomenon detecting means for detecting a physical quantity attributable to a fire phenomenon, wherein said first auxiliary processing means is incorporated in each of said fire detectors and said second auxiliary processing means being incorporated in said receiving part.

* * * * *